US006468707B1

(12) United States Patent
Okuno et al.

(10) Patent No.: US 6,468,707 B1
(45) **Date of Patent: *Oct. 22, 2002**

(54) IMAGE-FORMING PROCESS AND IMAGE-FORMING APPARATUS

(75) Inventors: Hiroyoshi Okuno; Akira Matsumoto; Tsutomu Kubo; Yusaku Shibuya; Yutaka Sugizaki; Masahiro Okita; Naotaka Mukoyama, all of Minamiashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/576,548

(22) Filed: May 24, 2000

(30) Foreign Application Priority Data

Jul. 6, 1999 (JP) ..... 11-192271

(51) Int. Cl.[7] ..... G03G 13/14

(52) U.S. Cl. ..... 430/126; 430/108.7; 430/47; 430/124; 399/252

(58) Field of Search ..... 399/252; 430/124, 430/126, 110, 108.7, 47

(56) References Cited

U.S. PATENT DOCUMENTS 5,804,351 A * 9/1998 Takano et al. ..... 430/110
5,863,691 A * 1/1999 Yamazaki et al. ..... 430/110

FOREIGN PATENT DOCUMENTS

| | | |
|---|---|---|
| JP | A 56-126872 | 10/1981 |
| JP | A 58-88770 | 5/1983 |
| JP | A 58-140769 | 8/1983 |
| JP | A 59-133573 | 7/1984 |
| JP | A 59-157661 | 9/1984 |
| JP | A 2-1870 | 1/1990 |
| JP | A 2-18671 | 1/1990 |
| JP | A 2-81053 | 3/1990 |
| JP | A 2-118672 | 5/1990 |
| JP | A 2-157766 | 6/1990 |
| JP | A 3-114063 | 5/1991 |
| JP | A 3-172880 | 7/1991 |
| JP | A 9-212010 | 8/1997 |
| JP | A 11-52610 | 2/1999 |

* cited by examiner

*Primary Examiner*—Christopher Rodee
(74) *Attorney, Agent, or Firm*—Oliff & Berridge, PLC

(57) ABSTRACT

An image-forming process capable of keeping a high transfer efficiency for a long period of time, reducing the amount of the toner to be recovered and wasted and obtaining stabilized images without causing image quality defects such as density lowering, density unevenness, ghosts, fog, etc., wherein inorganic fine particles contained in a toner transfer from the toner to an electrostatic latent image holder surface and attach thereto, the attached amount of the inorganic fine particles to the electrostatic latent image holder surface is from 1 to 20% as the average occupied area ratio ($C_{AV}$) in the electrostatic latent image holder surface, and the difference ($C_{MAX}$–$C_{MIN}$) of the maximum occupied area ratio and the minimum occupied area ratio of the attached inorganic fine particles in the electrostatic latent image holder surface is not larger than about 5%.

20 Claims, 2 Drawing Sheets

IMAGE-FORMING PROCESS AND IMAGE-FORMING APPARATUS

FIELD OF THE INVENTION

The present invention relates to an image-forming apparatus, such as a copying machine, printer, etc., of an electrophotographic system of forming monochromatic or multi-color images, particularly capable of omitting a cleaning apparatus, to an image-forming process using it, and to a toner used for these apparatus.

BACKGROUND OF THE INVENTION

Recently, with the rapid propagation of the employment of a computer system, a network system, etc., in offices, the market of copying machines, printers, etc., wherein a monochromatic system has hitherto been the mainstream, is changing to the market wherein a full color system is the mainstream. With the tendency, the requirement for a copying machine, a printer, etc., of an electrophotographic system, which have hitherto been advantageous in the points of the image quality, the speed, etc., has been more and more increased. Particularly, in addition to the increase of the image quality, the increase of the reliability, etc., as well as to small-sizing, light-weighing, the reduction of cost, and the increase of the speed, the ecological counterplans such as energy saving, resource saving, recycling, etc., have been strongly required. Also, to cope with the requirements, the improvements and the new developments of an image-forming process, an image-forming apparatus, and toners used for the system have been carried out.

An image-forming process by an electrophotographic system is generally consisted of an electrostatically charging step of uniformly charging an electrostatic latent image holder surface, a light-exposure step of light-exposing the electrostatic latent image holder surface to form an electrostatic latent image on the surface, a developing step of developing the latent image formed on the electrostatic latent image holder surface using a developer layer formed at a developer holder surface to obtain a toner image, a transfer step of transferring the toner image onto the surface of a transfer material, a fixing step of fixing the toner image on the transfer material, and a cleaning step of removing toners remaining on the electrostatic latent image holder surface in the transfer step.

The toner used for the image-forming process described above is required to have following many fundamental characteristics.

First, in the above-described development step, an appropriate toner charged amount, a charge-retaining property, an environmental stability, etc., are required. Also, in the above-described transfer step, a good transferring property, etc., are required. In the above-described fixing step, a low-temperature fixing property, an offset resistance, etc., are required. Also, in the above-described cleaning step, a good cleaning performance, a stain resistance, etc., are required. In particular, by the recent acceleration of the increase of the image quality, the increase of speed, the formation of color images, etc., the toners have been required to have more and more complicated characteristics.

For example, the image-forming process which recently becomes the mainstream as a full-color copying machine, printer, etc., capable of realizing the formation of images having a high image quality at high speed is an indirect transfer type image-forming process wherein an intermediate transfer material is used for more facilitating matching of the registration at forming color images in the above-described transfer step, and after transferring the toner image on the electrostatic latent image holder surface onto the intermediate transfer material, the toner image is transferred onto a transfer material.

However, in the indirect transfer-type image-forming process, because the transferring times of toners are increased, to realize a high image-quality, an excellent transfer performance is required. Accordingly, for the toners used, a more stabilized charging performance, additives for improving the transfer efficiency, the techniques of controlling the forms and surface structures of the toners, etc., are required.

Also, in the above-described cleaning step, not only from the view points of small-sizing and cost-reducing of the apparatus, and prolonging the life by the abrasion resistance of the electrostatic latent image holder but also from the ecological view points of energy saving, resource saving, the reduction of waste materials, etc., it becomes problems to reduce the amount of the toner remained at transferring and omit the cleaning apparatus.

Particularly, in a full-color image-forming apparatus using four-color developers of yellow, magenta, cyan, and black, the reduction of the amount of toners remained at transferring, omitting the cleaning apparatus, etc., are important problems to be improved.

For the above-described problems, from the view point of generating no waste toners, a cleaner-less system of recovering the toner remained at transferring simultaneously with development without forming a cleaning step is proposed in Japanese Patent Laid-Open Nos. 133573/1984 and 157661/1984.

However, in the above-described cleaner-less system, waste toner is not generated but because foreign matters such as paper powders, etc., are recovered in a developing apparatus together with the remaining toner, there is a problem that the life of the developer is shortened.

On the other hand, a cleaner-less system of not recovering a remained toner is proposed but in the system, there are problems of causing a positive ghost that the toner remained on an electrostatic latent image holder surface is printed and a negative ghost by the light-shielding effect of the toner remained on the electrostatic latent image holder surface.

To avoid the occurrence of the problems of these ghosts, for example, in Japanese Patent Laid-Open No. 114063/1991, a technique of reducing the amount of the toner remained at transferring to 0.35 mg/cm$^2$ or less is proposed and also in Japanese Patent Laid-Open No. 172880/1991, a technique of increasing the transfer efficiency of the toner at transfer step to at least 80% is proposed. In these cleaner-less apparatus, it is required to keep the transfer efficiency of toner at a high level.

As the method of keeping the transfer efficiency of toner at a high level, there are a method of increasing the area of a bias applying portion of a transfer roller proposed in Japanese Patent Laid-Open No. 126872/1981, a method of applying an AC transferring electric field proposed in Japanese Patent Laid-Open Nos. 88770/1983 and 140769/1983, etc.

According to these methods, the transfer efficiency of toner is improved but it is difficult to completely transfer the toner particles directly attached to the electrostatic latent image holder surface and thus these methods are insufficient as a cleaner-less apparatus.

To increase the transfer efficiency of toner, it is important to completely transfer the toner particles directly attached to the electrostatic latent image holder surface and for the purpose, it is effective to lower the adhesive force between the toner particles and the electrostatic latent image holder surface. As such a method, there is a method wherein releasing fine particles such as silica, etc., are incorporated in a developer and the fine particles are placed between toners and the electrostatic latent image holder surface to lower the adhesive force between the toner and the electrostatic latent image holder surface, whereby the transfer efficiency of the toner is increased as proposed by Japanese Patent Laid-Open Nos. 1870/1990, 81053/1990, 18671/1990, 118672/1990, and 157766/1990.

However, in these methods, because to increase the transfer efficiency, it is necessary to highly establish the covering ratio of the toner surfaces by the fine particles, it is required to add a large amount of the fine particles. Thereby, there occur the problems that the charging property of the toner is deteriorated and the liberated fine particles are liable to attach to the electrostatic latent image holder to cause problems of filming, the hindrance of the fixing property, etc.

Also, because by a strong stress causing by stirring in the developing apparatus, a layer regulation, etc., embedding, releasing, etc., of the fine particles occur, there is a problem that the high transfer efficiency is kept for a long time.

Also, because when silica fine particles are used as the fine particles, the transfer efficiency is improved but the environmental reliance is large, there is a problem that under a low-temperature low-humidity environment, an image density unevenness occurs and under a high-temperature high-humidity environment, a fog, etc., are liable to occur.

As a method of solving the above-described problems and obtaining a high transfer efficiency of toner, the present applicant, etc., previously proposed a method of attaching fine particles onto the electrostatic latent image holder surface and developing an electrostatic latent image formed thereon by a toner in Japanese Patent Laid-Open No. 212010/1997. Also, the present applicant, etc., previously proposed a method of attaching fine particles onto the electrostatic latent image holder surface and also externally adding fine particles onto the surfaces of spherical toners in Japanese Patent Laid-Open No. 52610/1999.

According to these methods, because the transfer efficiency of the toner is greatly improved, image defects such as ghosts and fog, etc., by the toner remained at transferring do not occur for a long period of time.

However, because in these methods, a step of uniformly attaching the fine particles on the electrostatic latent image holder surface before developing the latent image formed on the electrostatic latent image holder surface by the toner, from the view points of simplifying and small-sizing the image-forming apparatus, increasing the image-forming speed, increasing the productivity of the electrostatic latent image holder, reducing the cost, etc., these methods are not always satisfactory and thus a further improvement has been desired.

Also, in these methods, it is considered to be important to always keep the amount of the fine particles attaching to the electrostatic latent image holder surface and the dispersibility of the fine particles at the optimum states, but because the amount of the fine particles supplied from the toner to the electrostatic latent image holder surface and attaching the surface in the fine particles attached to the electrostatic latent image holder surface differs according to the developing amount with the toner, the amount thereof differs by the kind of images, the number of sheets, etc., to be printed, an image quality hindrance caused thereby sometimes occurs.

That is, because the attaching amount of the fine particles onto the electrostatic latent image holder surface is changed by the change of the number of the printed sheets, and also according to the difference in image densities, a difference of the attached amount of the fine particles between an imaged portion and a non-imaged portion occurs, the image defects such as the change of image density, the density unevenness, ghosts, etc., considered to be caused by the difference of the surface potential after charging and light exposing corresponding to the attached amount of the fine particles on the electrostatic latent image holder surface or by the differences in the development efficiencies, the transferring efficiencies, etc., sometimes occur.

Also, actually, in these methods, the use of fine particles of relatively small particle sizes the surfaces of which were subjected to a hydrophobic treatment is liable to be attached to electrostatic latent image holder surface and shows a larger effect of improving the transfer efficiency, but because the fine particles of relatively small particle sizes subjected to a hydrophobic treatment show a very strong aggregating property, it is very difficult to uniformly attach the fine particles onto the electrostatic latent image holder surface in the state of near the primary particle size in, as a matter of course, the initial supply of the fine particles and in the supplying course of the fine particles from the toner, and it sometimes happens to become the state of attaching non-uniform fine particles containing many aggregated fine particles.

Because in such a case, the difference in the attached amounts of the fine particles by the difference in the above-described developing amounts is liable to become large, in addition to the problems of causing the image density change, the density unevenness, ghosts, etc., there are problems that the image quality defects such as white spots, black spots, etc., by the aggregated fine particles occur.

Such a problem of attaching materials onto the electrostatic latent image holder surface is an important problem not only from the view point of the improvement of the image quality reliance but also from the view points of prolonging the life of the electrostatic latent image holder, lowering the cost thereof, energy saving, resource saving, etc.

That is, in an image-forming apparatus equipped with a cleaning apparatus such as an elastic blade, etc., to the electrostatic latent image holder, which becomes the mainstream at present, the life of the electrostatic latent image holder is almost determined by the abrasion, scratches, etc., by the blade but in the image-forming apparatus of a cleaner-less system, the electrostatic latent image holder surface is not abraded but it is considered that the life of the electrostatic latent image holder is determined by the image defects caused by the attached materials such as the above-described fine particles in the toner, the toners, the toner composition, a carrier, a carrier coating agent composition, and other foreign matters, etc. Particularly, by recent small-sizing of the apparatus, because in the case of using the electrostatic latent image holder having a small diameter, etc., the usable electrostatic latent image holder surface area becomes smaller, the problem of shortening the life of the electrostatic latent image holder by these attached materials is the important problem to be improved.

Also, in the case of not using a cleaning apparatus of removing the toner remaining on the electrostatic latent image holder surface, the toner, the fine particles, etc., attached to the electrostatic latent image holder surface stain the members such as the charging device, etc., in contact with the electrostatic latent image holder, which causes the charging failure, etc.

Accordingly, from these view points, the control of the supplying amount of the fine particles is the important improving problem. As described above, in order to supply hardwares, toners, etc., capable of satisfying the recent high market requirements of the formation of color images of high image quality, the increasing the image-forming speed, the high reliance, small-sizing and cost-reducing of the apparatus, and coping with the ecology, there yet exist problems to be solved.

SUMMARY OF THE INVENTION

The present invention has been made for solving the above-described various problems in the techniques of related art and for attaining the following features and provides an image-forming process capable of obtaining images having stabilized image quality giving a reduced amount of toners to be recovered and wasted without causing the image quality defects such as lowering of density, a density unevenness, ghosts, fog, etc., for a long period of time by keeping a high toner transfer efficiency for a long period of time, provides toners used for the image-forming process, and also provides an image-forming apparatus used for the process.

The present invention is as follows.

That is, a 1st aspect of the invention is an image-forming process of forming images on the surface of a transfer material including a developing step of obtaining a toner image by developing an electrostatic latent image on an electrostatic latent image holder surface using a layer of a developer containing at least a toner on the surface of a developer-holding member, a transfer step of transferring the toner image onto the surface of a transfer material, and a fixing step of fixing the toner image on the surface of the transfer material, wherein the toner contains at least toner particles and inorganic fine particles, the inorganic fine particles transfer from the toner to the electrostatic latent image holder surface and attach thereto and the attached amount of the inorganic fine particles attached to the electrostatic latent image holder surface is from about 1 to 20% by the average occupied area ratio ($C_{AV}$) in the electrostatic latent image holder surface, and the difference ($C_{MAX}-C_{MIN}$) of the maximum occupied area ratio and the minimum occupied area ratio of the attached inorganic fine particles in the electrostatic latent image holder surface is not larger than about 5%.

A 2nd aspect of the invention is an image-forming process of forming an images on the surface of a transfer material including a developing step of obtaining a toner image by developing an electrostatic latent image on an electrostatic latent image holder surface using a layer of a developer containing at least a toner on the surface of a developer-holding member, a 1st transfer step of transferring the toner image onto the surface of an intermediate transfer member, a 2nd transfer step of transferring the toner image on the surface of the intermediate transfer member on to the surface of a 2nd transfer material, and a fixing step of fixing the toner image on the surface of the transfer material, wherein the toner contains at least toner particles and inorganic fine particles, the inorganic fine particles transfer from the toner to the electrostatic latent image holder surface and attach thereto and the attached amount of the inorganic fine particles attached to the electrostatic latent image holder surface is from about 1 to 20% by the average occupied area ratio ($C_{AV}$) in the electrostatic latent image holder surface, and the difference ($C_{MAX}-C_{MIN}$) of the maximum occupied area ratio and the minimum occupied area ratio of the attached inorganic fine particles in the electrostatic latent image holder surface is not larger than about 5%.

In the image-forming process of the above-described 1st aspect or 2nd aspect, it is preferred that the ratio (a2/a1) of the average primary particle size (volume average primary particle size) of the inorganic fine particles contained in the toner (hereinafter, is sometimes referred to as simply "average primary particle size") (a1) and the average aggregated particle size (volume average aggregated particle size) of the transferred and attached inorganic fine particles (hereinafter, is sometimes referred to as simply "average aggregated particle size") (a2) is not larger than about 5.

A 3rd aspect of the invention is a toner used for the image-forming process of the above-described aspect 1 or 2.

In the toner of the 3rd aspect, it is preferred that the inorganic fine particles in the toner are subjected to a surface hydrophobic treatment and the average primary particle size (a1) thereof is from about 10 to 50 nm.

Also, in the toner of the 3rd aspect, it is preferred that the ratio ($C/C_0$) of the calculated covering ratio ($C_0$) of the inorganic fine particles in the surfaces of the toner particles and the practically measured covering ratio (c) is at least about 0.6.

Furthermore, in the toner of the 3rd aspect, it is preferred that the inorganic fine particles are attached to the toner particles, and in the inorganic fine particles attached thereto, the ratio of the weakly attached inorganic fine particles is not larger than about 40% by weight, and the ratio of the strongly attached inorganic fine particles is not larger than about 80% by weight.

Also, in the toner of the 3rd aspect, it is preferred that the inorganic fine particles are titanium oxide fine particles having a volume resistivity of from about $1\times10^{10}$ to $1\times10^{14}$ Ωcm.

Furthermore, in the toner of the aspect 3, it is preferred that the calculated covering ratio ($C_0$) of the inorganic fine particles in the surfaces of the toner particles is from about 10 to 50%.

Also, in the toner of the 3rd aspect, it is preferred that the sphericity of the toner particle is not more than about 130.

Still further, in the toner of the 3rd aspect, it is preferred that the average primary particle size thereof is larger than the average primary particle size of the inorganic fine particles attached to the electrostatic latent image holder surface, and at least one kind of the spherical fine particles of from about 30 to 200 nm are attached to the surfaces of the toner particles.

Also, in the toner of the 3rd aspect, it is preferred that the spherical fine particles are silica fine particles subjected to a surface hydrophobic treatment.

A 4th aspect of the invention is an image-forming apparatus of forming an image on the surface of a transfer material equipped with a developing unit of obtaining a toner image by developing an electrostatic latent image on an electrostatic latent image holder surface using a layer of a developer containing at least a toner on the surface of a developer-holding member, a transfer unit of transferring the toner image onto the surface of a transfer material, and a fixing unit of fixing the toner image on the surface of the transfer material, wherein the toner contains at least toner particles and inorganic fine particles, the inorganic fine particles transfer from the toner to the electrostatic latent image holder surface and attach thereto and the attached amount of the inorganic fine particles attached to the electrostatic latent image holder surface is from about 1 to 20% by the average occupied area ratio ($C_{AV}$) in the electrostatic latent image holder surface, and the difference ($C_{MAX}$–$C_{MIN}$) of the maximum occupied area ratio and the minimum occupied area ratio of the attached inorganic fine particles in the electrostatic latent image holder surface is not larger than about 5%.

A 5th aspect of the invention is an image-forming apparatus of forming an image on the surface of a transfer material equipped with a developing unit of obtaining a toner image by developing an electrostatic latent image on an electrostatic latent image holder surface using a layer of a developer containing at least a toner on the surface of a developer-holding member, a 1st transfer unit of transferring the toner image onto the surface of an intermediate transfer member, a 2nd transfer unit of transferring the toner image on the surface of the intermediate transfer member on to the surface of a second transfer material, and a fixing unit of fixing the toner image on the surface of the transfer material, wherein the toner contains at least toner particles and inorganic fine particles, the inorganic fine particles transfer from the toner to the electrostatic latent image holder surface and attach thereto and the attached amount of the inorganic fine particles attached to the electrostatic latent image holder surface is from about 1 to 20% by the average occupied area ratio ($C_{AV}$) in the electrostatic latent image holder surface, and the difference ($C_{MAX}$–$C_{MIN}$) of the maximum occupied area ratio and the minimum occupied area ratio of the attached inorganic fine particles in the electrostatic latent image holder surface is not larger than about 5%.

In the image-forming apparatus of the 4th or 5th aspect, it is preferred that the ratio (a2/a1) of the average primary particle size of the inorganic fine particles contained in the toner (a1) and the average aggregated particle size of the transferred and attached inorganic fine particles (a2) is not larger than about 5.

In the image-forming apparatus of the 4th or 5th aspect, it is preferred that the inorganic fine particles are subjected to a surface hydrophobic treatment, and the average primary particle size (a1) is from 10 to 50 nm.

Also, in the image-forming apparatus of the 4th or 5th aspect, it is preferred that the inorganic fine particles are titanium oxide fine particles having a volume resistivity of from about $1\times10^{10}$ to $1\times10^{14}$ Ωcm.

BRIEF DESCRIPTION OF THE DRAWINGS

Preferred embodiment of the present invention will be described in detail on the following figures, in which.

DETAILED DESCRIPTION OF THE INVENTION

Figure 1:
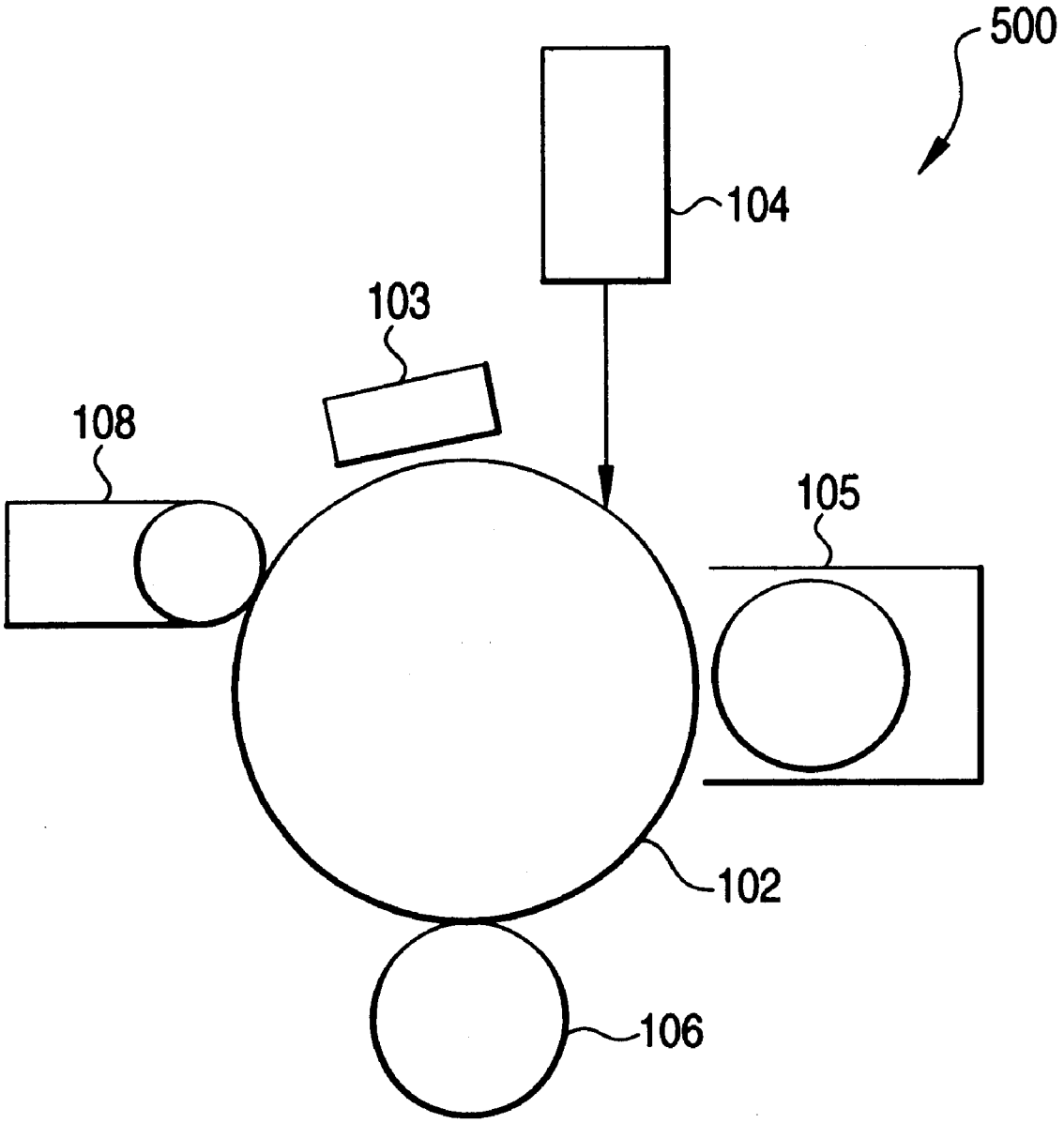
FIG. 1 is a schematic cross-sectional view showing an embodiment of the image-forming apparatus of the invention.

Then, the present invention is described in detail.

[Image-forming Process]

In the image-forming process of the invention, the inorganic fine particles contained in the toner transfer from the toner to the electrostatic latent image holder surface and attach thereto. Also, the image-forming process of the invention includes a developing step, a transfer step, and a fixing step, and also, if necessary, includes other steps.

The above-described toner contains at least toner particles and inorganic fine particles. The reason that the toner contains the inorganic fine particles is as follows. That is, in the image formation, to increase the transfer efficiency of the toner, it is important to completely transfer the toner directly attached to the electrostatic latent image holder surface. For the purpose, it is effective to lower the adhesive force between the toner and the electrostatic latent image holder surface, and, for example, a method of lowering the adhesive force by placing fine particles, etc., between the electrostatic latent image holder surface and the toner is considered.

In this case, in the method of previously attaching fine particles, etc., to an electrostatic latent image holder surface, which has hitherto been carried out, there are problems that the fine particles cannot be uniformly attached to the electrostatic latent image holder surface, and in an image-forming step, it sometimes happens that the fine particles attached to the electrostatic latent image holder surface are released from the surface by a developing unit, a transfer unit, a charging unit, etc., and in this case, there occur troubles that accompanied by the image formation, the amount of the fine particles attached to the electrostatic latent image holder surface changes to cause image defects, etc.

However, as described above, by incorporating inorganic fine particles in the toner side as in the invention, the above-described troubles are prevented, and the images without having image defects can be easily formed with a high transfer efficiency.

As the attached amount of the inorganic fine particles in the electrostatic latent image holder surface, in the case of forming images on the surfaces of, for example, 1000 transfer sheets, it is preferred that the average occupied area ratio ($C_{AV}$) of the inorganic fine particles in the electrostatic latent image holder surface is from 1 to 20%. Also, the average occupied area ratio ($C_{AV}$) is more preferably from 2 to 15%, and particularly preferably from 3 to 10%.

When the average occupied area ratio ($C_{AV}$) is less than 1%, the possibility of the inorganic fine particles existing between the electrostatic latent image holder surface and the toner becomes lower to increase the contact area between the electrostatic latent image holder and the toner, whereby the non-electrostatic adhesive force between the electrostatic latent image holder surface and the toner is increased and it sometimes happens that the transfer efficiency of the toner cannot be kept at a value near 100%. Particularly, when the image-forming apparatus is repeatedly used, it sometimes happens that the inorganic fine particles attached to the surface of the toner are embedded in the toner by the strong stress, etc., caused by stirring in the developing apparatus and the layer regulation, and also lower of the transfer efficiency in the case of releasing the inorganic fine particles from the surface of the toner becomes large.

On the other hand, when the average occupied area ratio ($C_{AV}$) exceeds 20%, the essential charging performance of the electrostatic latent image holder is changed, whereby there occur the problems that the image density is lowered by hindrances of electrostatic charging and light exposure, and the environmental fluctuation is increased, etc., and also a problem of lowering the developing property which is considered to be caused by the change of the surface structure of the electrostatic latent image holder, etc., is liable to occur.

In the invention, the average occupied area ratio ($C_{AV}$) of the inorganic fine particles is measured and calculated as follows.

That is, using an X-ray photoelectronic spectroscope (JPS-9000MX, manufactured by JEOL LTD.), about each of the electrostatic latent image holder surface before forming images, the inorganic fine particle simple substance, and the electrostatic latent image holder surface after forming images, a signal intensity (the signal intensity originated in the metal element contained in the inorganic fine particles) is measured. When the values obtained about the electrostatic latent image holder surface before forming images, the inorganic fine particle simple substance, and the electrostatic latent image holder surface after forming images are shown by A, B, and C, respectively, the occupied area ratio is calculated by the following calculation formula.

The occupied area ratio of the inorganic fine particles= $(C-A)/B\times100\%$.

In addition, in the above-described measurement and calculation, in the electrostatic latent image holder surface before forming images, and the electrostatic latent image holder surface after forming images, a definite range of 7×6 mm is measured 10 times under the conditions of an accelerating voltage of 10 kV and an electric current of 20 mA and the mean value thereof is employed.

Also, the occupied area ratio ($C_{AV}$) of the inorganic fine particles is value obtained by measuring each occupied area ratio of the inorganic fine particles about at least 5 portions of each electrostatic latent image holder surface and averaging the values obtained.

Furthermore, the electrostatic latent image holder surface after forming images described above is one measured in the state after forming images on the surfaces of 1000 sheets of transfer materials, and as the transfer materials, L papers (manufactured by FUJI XEROX CO., LTD.) of A4 (210 mm×297 mm) are used in the lengthwise direction.

As the attached state of the inorganic fine particles in the electrostatic latent image holder surface, for example, in the case of forming images on the surfaces of the 1000 transfer materials, the difference ($C_{MAX}-C_{MIN}$) of the maximum occupied area ratio and the minimum occupied area ratio of the attached inorganic fine particles in the electrostatic latent image holder surface (hereinafter, is sometimes referred as simply "difference ($C_{MAX}-C_{MIN}$)" is preferably not larger than 5%, more preferably not larger than 4%, and particularly preferably not larger than 3%.

When the difference ($C_{MAX}-C_{MIN}$) exceeds 5%, in the case of particularly forming halftone images, there is a problem that between the portion that the occupied area ratio of the inorganic fine particles is maximum and the portion that the occupied area ratio thereof is minimum in the electrostatic latent image holder surface, a difference in densities of the image formed sometimes occurs.

As a practical example of the above-described problem, there is a so-called ghost phenomenon that after continuous printing a same image on several tens or several hundreds sheets, the imaged portion formed before appears as a density difference in a halftone portion.

In addition, as the causes of the ghost phenomenon, the difference in the surface potential of the electrostatic latent image holder by the difference in the attached amount of the inorganic fine particles, the difference in the developing property and the difference in the transfer efficiency by the difference of the structure of the electrostatic latent image holder surface, etc, are considered.

In this case, about the values of the maximum occupied area ratio ($C_{MAX}$) and the minimum occupied area ratio ($C_{MIN}$) described above, there are following two kinds of calculation methods.

First Calculation Method:

A method of using the maximum value of the occupied area ratios of the inorganic fine particles obtained in the case of calculating the above-described average occupied area ratio ($C_{AV}$) as the maximum occupied area ratio ($C_{MAX}$) and using the minimum value of the occupied area ratios of the inorganic fine particles in the case of calculating the average occupied area ratio ($C_{AV}$) as the minimum occupied area ratio ($C_{MIN}$).

Second Calculation Method:

A method, in the case of existing a feature in the printed image, of measuring the occupied area ratio of the inorganic fine particles in the portion the most imaged portion and calculating the obtained value as the maximum occupied area ratio ($C_{MAX}$), and also, of measuring the occupied area ratio of the inorganic fine particles in the portion the most non-imaged portion and calculating the obtained value as the minimum occupied area ratio ($C_{MIN}$).

In addition, in the invention, the values of the maximum occupied area ratio ($C_{MAX}$) and the minimum occupied area ratio ($C_{MIN}$) may be calculated using each of the calculation methods.

Furthermore, the electrostatic latent image holder surface after forming images described above is one measured in the state after forming images on the surfaces of 1000 sheets of transfer materials, and as the transfer materials, L papers (manufactured by FUJI XEROX CO., LTD.) of A4 are used in the lengthwise direction.

It is preferred that the inorganic fine particles are not aggregated in the electrostatic latent image holder surface and are dispersed in a state near the primary particle size. Accordingly, in the inorganic fine particles contained in the toner, the ratio (a2/a1) of the average primary particle size (a1) and the average aggregated particle size (a2) of the inorganic fine particles transferred and attached to the electrostatic latent image holder surface (hereinafter, the ratio is sometimes referred as simply as "ratio (a2/a1)") becomes preferably not larger than about 5, more preferably not larger than 4, and particularly preferably not larger than 3.

Because the above-described ratio (a2/a1) is taken as an index of showing the dispersibility of the inorganic fine particles in the electrostatic latent image holder surface, when the ratio exceeds 5, the dispersibility of the inorganic fine particles in the electrostatic latent image holder surface becomes inferior and the attached amount of the inorganic fine particles required for attaining almost 100% of the transfer efficiency of the toner becomes large. Accordingly, it sometimes happens that defects occur in the images formed and the life of the electrostatic latent image holder is shortened.

The phenomenon that the inorganic fine particles transfer from the toner to electrostatic latent image holder surface and attach thereto may be carried out in one of the developing step and the transfer step in the steps of the image-forming process of the invention without need of being carried out in both the steps.

(Developing Step)

The developing step is a step of obtaining a toner image by developing an electrostatic latent image on the electrostatic latent image holder surface using a developer layer containing at least the toner formed on the surface of a developer holder. In the developing step, the developer layer is conveyed to a developing nip, the develop layer and the electrostatic latent image holder are disposed at the developing portion in a contact state or with a definite gap, and while applying a bias between the developer holder and the electrostatic latent image holder, the electrostatic latent image on the electrostatic latent image holder surface is developed with the toner.

The developer contains at least the toner and contains, if necessary, other component(s). Also, as the developer, there are a so-called two-component developer of electrostatically charging the toner using a carrier and a one-component developer of charging the toner by forming a thin layer on the developer holder using a layer regulation blade, etc.

In addition, if desired, it is possible to previously attach the inorganic fine particles onto the electrostatic latent image holder surface before the above-described developing step. In this case, the amount of the inorganic fine particles which are previously attached is preferably from 1 to 15%, and more preferably from 1 to 10% as the average occupied area ratio ($C_{AV}$) in the electrostatic latent image holder surface.

When the amount of the inorganic fine particles is outside the above-described numerical range, it sometimes happens that the attached amount of the inorganic fine particles in the case of forming images on the surfaces of plural transfer materials cannot be controlled within the numerical range of the invention.

(Transfer Step)

The above-described transfer step is the step including a step of directly transferring a toner image formed on the electrostatic latent image holder surface onto the surface of a transfer material or the step including a 1st transfer step of transferring the toner image onto the surface of an intermediate transfer member and a 2nd transfer step of transferring the toner image on the surface of the intermediate transfer member onto the surface of a 2nd transfer material.

As the transferring method, there are a contact type transfer of transferring the toner image onto the surface of the transfer material by contacting a transfer roller, a transfer belt, etc., onto the electrostatic latent image holder and a non-contact type transfer of transferring the toner image onto the surface of a transfer material using Corotron, etc.

Particularly, in a full-color image-forming apparatus, a known transfer method such as a method of directly transferring toners of 4 colors of yellow, magenta, cyan, and black on a transfer paper using a transfer roller having wound thereon a transfer paper, a transfer belt, etc., and a transfer method of an indirect transfer system of after transferring the above-described toners of 4 colors onto the surface of an intermediate transfer material of a belt-form or a cylindrical form, etc., in multiple layers (1st transfer step), transferring the transferred toner image onto a transfer material (2nd transfer step) is suitably used.

(Fixing Step)

The fixing step is the step of fixing the toner image transferred onto the surface of the transfer material, and fixing by a heat-fixing system, etc., are appropriately used.

(Other Steps)

As other steps, there are, for example, a charging step, a light-exposure step, a cleaning step, etc.

The charging step is the step of uniformly electrostatically charging the electrostatic latent image holder surface and as a charging method in the charging step, a known method using non-contact charging by Corotron, etc., or contact charging by a charging roll, a charging film, a charging brush, etc., can be selectively used but from the view point of reducing the generating amount of ozone, a contact charging device is appropriately used.

The light-exposure step is the step of forming an electrostatic latent image on the electrostatic latent image holder surface by light-exposing the electrostatic latent image holder surface (the surface of a photosensitive layer, a dielectric layer, etc.) after the above-described charging step by an electrophotographic method or an electrostatic recording method, etc. The light-exposure method in the light-exposure step can be properly selected from known light-exposure methods.

According to the image-forming process of the invention, by keeping a high toner transfer efficiency for a long period of time, the amount of toners to be recovered or wasted is reduced, and further, stabilized images causing no image defects such as lowering of density, density unevenness, ghosts, fog, etc., can be obtained for a long period of time.

(Toner)

The toner of the invention contains at least toner particles and the inorganic fine particles, and if necessary, contains other component(s) (external additive(s)). Also, the toner of the invention is used for the image-forming process of the invention.

(Toner Particles)

The toner particles contain at least a binder resin and a coloring agent, and if necessary, contain other component(s) (external additive(s)), Binder Resin and Coloring Agent:

The material for the binder resin includes known materials such as polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, polyester, polyurethane, an epoxy resin, a silicone resin, polyamide, denatured rosin, a paraffin wax, etc., and in these materials, a styrene-acrylic copolymer and polyester are suitably used.

The coloring agent suitably includes the known coloring agents such as carbon black, Aniline Blue, Chalcoyl Blue, chrome yellow, Ultramarine Blue, Du Pont Oil Red, Quinoline Yellow, Methylene Blue Chloride, Copper Phthalocyanine, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Yellow 180, C.I. Pigment Blue 15:1, C.I. Pigment Blue 15:3. etc.

The compounding amount of the coloring agent to the binder resin is preferably from 1 to 30 parts by weight, and more preferably from 2 to 20 parts by weight to 100 parts by weight of the binder resin.

When the compounding amount of the coloring agent is less than 1 part by weight, the coloring power of the coloring agent sometimes becomes insufficient, while when the compounding amount thereof exceeds 30 parts by weight, the charging property and the fixing property of the toner become sometimes inferior.

Other Component(s) (Internal Additive(s)):

Other additives (internal additive(s)) described above include a magnetic substance, a releasing agent, a charge-controlling agent, etc.

In the case of the toner of a so-called one-component developer, the magnetic substance can be incorporated in the toner mother particles. The magnetic substance can be properly selected from known magnetic substances usually used. For example, there are metals such as iron, cobalt, nickel, etc., and the alloys thereof, metal oxides such as $Fe_3O_4$, $\gamma$-$Fe_2O_3$, cobalt-added iron oxide, etc., and ferrites such as a MnZn ferrite, a NiZn ferrite, etc. The content of the magnetic substance in the toner mother particles is preferably from 30 to 70% by weight. Also, these magnetic substances may be used singly or as a mixture of two or more kinds.

The releasing agent can be incorporated in the toner mother particles for the purpose of improving the gloss, and an offset resistance. As the releasing agent, for example, a paraffin having at least 8 carbon atoms, polyolefin, etc., are preferred and practical examples include a paraffin wax, a paraffin latex, a microcrystalline wax, a carnauba wax, polypropylene, polyethylene, etc. They can be used singly or as a mixture of two or more kinds thereof.

The charge-controlling agent can be contained in the toner particles for the purpose of assisting the charging the toner. For example, when the toner is used as a negative-charging toner, the charge-controlling agent includes azo complex salt dyes of chromium, iron, etc.; known complex compounds of chromium, zinc, aluminum, boron, etc., of salicylic acid; charge-controlling resins, etc. Also, when the toner is used as a positive-charging toner, the charge-controlling agent includes known charge-controlling agents such as quaternary ammonium salts, etc. They may be used singly or as a mixture of two or more kinds thereof.

The average particle size (volume average particle size) of the toner particles (hereinafter, is sometimes referred to as simply "average particle size") is preferably from 3 to 10 $\mu$m, and more preferably from 4 to 8 $\mu$m.

When the average particle size of the toner particles is shorter than 3 $\mu$m, the fluidity of the particles is greatly reduced, whereby it becomes difficult to uniformly charge the toner and to uniformly form the developer layer, which sometimes cause generate fog and dart. On the other hand, when the average particle size exceeds 10 $\mu$m, the resolvability is lowered and a high image quality is not sometimes obtained.

In this case, the average particle sizes of the toner can be measured using a Coulter Multisizer 11 (manufactured by Coulter Electronics Inc.).

The form of the toner mother particles is preferably a spherical form. Also, the sphericity of the toner particles is preferably 130 or lower, and more preferably 125 or lower.

When the sphericity thereof exceeds 130, it sometimes happens that the transfer efficiency of near 100% cannot be obtained.

In this case, the sphericity can be obtained by measuring the maximum length (ML) of the toner particles and the area (A) of the toner particles about the two-dimensional projected images of at least 100 toner particles input from an optical microscope, by an image analyzing apparatus, LUZEXIII (manufactured by NIRECO, Inc.), averaging the measured results, and calculating by the following formula;

$$\text{Sphericity}=ML^2\times\pi/4A\times100$$

There is no particular restriction on the production method of the toner particles and known production methods can be used. For example, there is a method of kneading and grinding, that is, a method of pre-mixing a binder resin, a coloring agent, and other component(s) (internal additive(s)) (hereinafter, they are sometimes referred as "toner materials"), thereafter, melt-kneading the mixture by a kneader, after cooling, grinding the kneaded mixture and classifying, and shereing the classified product by heating. Also, there is an in-liquid drying method of dispersing in an aqueous medium oily components obtained by dissolving and dispersing the above-described toner materials in an organic solvent and removing the aqueous solvent. Furthermore, there are a melt-suspension method of after kneading the above-described toner materials, heating the kneaded toner materials in an immiscible solvent, and forming particles in a molten state, and a polymerization method by a suspension polymerization, an emulsion polymerization, etc.

(Inorganic Fine Particles)

The reason of containing the inorganic fine particles is as mentioned in the term of the image-forming process. The average primary particle size of the inorganic fine particles is preferably from 10 to 50 nm, more preferably from 10 to 40 nm, and particularly preferably from 15 to 30 nm.

When the average primary particle size thereof exceeds 50 nm, the inorganic fine particles are liable to be released from the surfaces of the toner particles, whereby it sometimes becomes difficult to control the transferring amount of the inorganic fine particles from the toner to the electrostatic latent image holder surface within the above-described numerical range. Also, because in this case, the developed amount does not become uniform, it sometimes happens that an image density unevenness, ghosts, etc., are liable to occur. Furthermore, because the inorganic fine particles are liable to transfer to a charging roll, a charging film, etc., in contact with the electrostatic latent image holder, inferior charging is liable to occur.

On the other hand, when the above-described average primary particle size is shorter than 10 nm, because the aggregating property of the inorganic fine particles is increased, it becomes difficult to uniformly attach the inorganic fine particles to the electrostatic latent image holder surface, and also, the fluidity of the toner is sometimes deteriorated.

The inorganic fine particles are usually attached to the surfaces of the toner particles. The attaching ratio of the inorganic fine particles to the surfaces of the toner particles is expressed by the ratio ($C/C_0$) (hereinafter, is sometimes called as "the attaching ratio of the inorganic fine particles onto the surfaces of the toner particles") of the practically measured covering ratio (C) of the inorganic fine particles to the surfaces of the toner particles (hereinafter, is sometimes referred to as simply "covering ratio (C)") to the calculated covering ratio ($C_0$) of the inorganic fine particles in the surfaces of the toner particles (hereinafter, is sometimes referred as simply "covering ratio ($C_0$)") The attaching ratio of the inorganic fine particles onto the surfaces of the toner particles is preferably at least 0.6, more preferably at least 0.7, and particularly preferably at least 0.8.

When the attaching ratio of the inorganic fine particles to the surfaces of the toner particles is less than 0.6, the amount of the inorganic fine particles released from the surfaces of the toner particles is increased, whereby it sometimes becomes difficult to control the attaching amount of the inorganic fine particles onto the electrostatic latent image holder and also it sometimes becomes difficult to control the above-described ratio ($C/C_0$) to the value within the numeral range described above. Also, because the covering ratio (C) is lower, the transfer efficiency is inferior, it sometimes becomes difficult to keep the transfer efficiency of near 100%, and also by the inorganic fine particles released from the surfaces of the toner particles, a charging roll, a charging film, etc., is stained and the problems of image defects, etc., sometimes occur.

In this case, the covering ratio ($C_0$) is obtained by the following formula using the average toner particle size (dt (m)) of the toner, the average primary particle size (da (m)) of the inorganic fine particles, the specific gravity ($\rho t$) of the toner, the specific gravity (ρa) of the fine particles, the weight (Wt (kg)) of the toner, and the addition amount (Wa (kg)) of the inorganic fine particles;

$$\text{Covering ratio } (C_0)=\sqrt{3}/2\pi\times\rho t/\rho a\times dt/da\times Wa/Et\times 100\%.$$

Also, the covering ratio (C) is obtained as follows.

That is, first, using an X-ray photoelectronic spectroscope (JPS-9000MX, manufactured by JEOL LTD.), the signal intensity (the signal intensity originated in the metal element contained in the inorganic fine particles) of each of the toner particles, the inorganic fine particles, and the toner added with the inorganic fine particles is measured (measuring a definite range of 7×6 mm 10 times at an accelerating voltage of 10 Kv and an electric current of 20 mA), and when the measured values are shown by X, Y, and Z, respectively, the covering ratio (C) is obtained by the following formula;

$$\text{Covering ratio } (C)=(Z-X)/Y\times 100(\%)$$

In the inorganic fine particles attached to the toner mother particles, the ratio of the inorganic fine particles weakly attached thereto is preferably not more than 40% by weight, more preferably not more than 30% by weight, and particularly preferably not more than 20% by weight. Also, in the inorganic fine particles strongly attached to the toner particles, the ratio of the inorganic fine particles strongly attached thereto is preferably not more than 80% by weight, and more preferably not more than 70% by weight.

When the ratio of the inorganic fine particles weakly attached to the toner particles exceeds 40% by weight, the inorganic fine particles attached to the toner particles easily transfer to the electrostatic latent image holder surface at development and transfer, which is sometimes undesirable for controlling the attached amount of the inorganic fine particles. Also, when the ratio exceeds 40% by weight, it sometimes happens that a charging member, etc., are liable to be stained.

On the other hand, when the ratio of the inorganic fine particles strongly attached to the toner particles exceeds 80% by weight, the amount of the inorganic fine particles transferring to the electrostatic latent image holder surface becomes extremely small, whereby it sometimes becomes difficult to keep the transfer efficiency at the value of near 100%.

The ratio of the inorganic fine particles weakly attached to the toner particles and the ratio of the inorganic fine particles strongly attached thereto are measured and calculated as follows.

That is, first, 2 g of the toner to be measured is dispersed in 40 ml of a 0.2% by weight Triton solution (polyoxyethylene octylphenyl ether having 100 of degree of polymerization, manufactured by Wako Pure Chemical Industries, Ltd.), a ultrasonic oscillator (diameter of oscillator stylus: 3 mmϕ) of an oscillation frequency of 20 kHz is immersed in the solution, using a ultrasonic oscillating apparatus (ultrasonic wave homogenizer, US300T: manufactured by Nippon Seiki Seisakusho K.K.), and a ultrasonication is carried out for one minute at an output of 20 W to release the inorganic fine particles from the toner particles to some extent. Thereafter, using a centrifugal separator equipped with a precipitating tube of 50 cc (small-sized cooling high-speed centrifugal separator, Model M 160-IV, manufactured by Sakuma Seisakusho K.K.), the toner is separated, after removing the supernatant liquid, the toner separated is washed with pure water and dried. About the toner obtained, a covering ratio (C) is measured using the X-ray photoelectronic spectroscope by the same method as measured the above-described covering ratio (C), and the value obtained is shown by a.

Then, in the above-described measurement, by the same manner as the above-described measurement except that the output of the ultrasonic oscillating apparatus is changed to 50W and the time for the ultrasonication is changed to 30 minutes, a covering ratio (C) is measured, and the value obtained is shown by b.

Furthermore, about the toner without being subjected to the above-described ultrasonication, by carrying out the same measurement as described above, a covering ratio (C) is measured, and the value obtained is shown by $C_b$. Then, the ratio of the inorganic fine particles weakly attached to the toner particles can be obtained by $(C_b-a)/C_b\times 100$ (%) and the ratio of the inorganic fine particles strongly attached thereto can be obtained by $b/C_b\times 100$ (%)

Accordingly, the inorganic fine particles weakly attached to the toner particles mean the inorganic fine particles having an adhering force of an extend of being released from the toner particles in the case of applying the ultrasonication for one minute at an output of 20W in the above-described measurement. On the other hand, the inorganic fine particles strongly attached to the toner particles mean the inorganic fine particles which are not released from the toner particles even after applying the ultrasonication for 30 minutes at an output of 50W in the above-described measurement.

The addition amount of the inorganic fine particles added to the toner particles cannot be generally defined because the addition amount thereof differs according to the kind of the inorganic fine particles, the average particle size of the toner particles, etc., but it is preferred that the inorganic fine particles are added so that the covering ratio ($C_0$) becomes from 10 to 50%, and it is more preferred that the fine particles are added so that the ratio becomes from 10 to 40%.

When the covering ratio ($C_0$) is less than 10%, the amount of the inorganic fine particles transferring from the toner to the electrostatic latent image holder surface and attaching thereto becomes extremely small, whereby the transfer efficiency of near 100% cannot be kept and also the fluidity and the charging property of the toner are sometimes reduced. On the other hand, when the covering ratio ($C_0$) exceeds 50%, it becomes difficult to control the attached amount of the inorganic fine particles in the electrostatic latent image holder surface and also, because the inorganic fine particles attached to the surfaces of the toner particles and the liberated inorganic fine particles are liable to transfer to a charging member such as a charging roll, a charging film, etc., it sometimes causes inferior charging.

Accordingly, the addition amount of the inorganic fine particles is preferably from 0.2 to 3.0 parts by weight to 100 parts by weight of the toner particles. Particularly, when the toner is the toner for a color image formation, when the addition amount of the inorganic fine particles exceeds 3.0 parts by weight, it sometimes happens that the problems of inferior fixing, lowering of the OHP transparency, etc., are liable to occur.

The inorganic fine particles includes the fine particles of metal oxides such as titanium oxide, silicon oxide, aluminum oxide, cerium oxide, magnesium oxide, etc., ceramics, carbon black, etc. In these materials, from the view points of the attaching and dispersing property in the electrostatic latent image holder surface and the fluidity and the charging property, etc., when the inorganic fine particles are added to the toner, the titanium oxide fine particles are particularly preferred. As the titanium oxide fine particles, in addition to rutile-type titanium oxide, anatase-type titanium oxide, amorphous titania, etc., non-burned metatianic acid, etc., can be used. Also, these inorganic fine particles may be used singly or as a mixture of two or more kinds.

The volume resistivity of the titanium oxide fine particles described above is preferably from $1\times10^{10}$ to $1\times10^{14}$ Ωcm, and more preferably from $1\times10^{11}$ to $1\times10^{13}$ Ωcm.

In this case, the volume resistivity can be measured by the following method.

That is, first, using a pair of circular pole plates (made of steel) each having a area of 20 $cm^2$ connected to an electrometer (KEITHLEY 610C, trade name, manufactured by KEYTHLEY, Inc.) and to a high-voltage power source (FLUKE 415B, trade name, manufactured by FKUKE, Inc.) as measuring jigs, a flat layer of the titanium oxide fine particles having a thickness of from about 1 to 2 mm is formed on the lower pole plate (one of the above-described circular pole plates) of the measuring jigs.

Then, the upper pole plate (the other of the circular pole plates) is placed on the layer of the titanium oxide fine particles, and after placing a weight of 4 kg on the upper pole plate to remove gaps among the fine particles in the layer of the titanium oxide fine particles, the layer of the titanium oxide fine particles is measured.

Furthermore, by applying a voltage of 1000 volts to both the pole plates, the electric current value is measured, and the volume resistivity is measured based on the following formula;

$$\text{Volume resistivity } \rho = V\times S\pm(A-A_0)\pm d(\Omega\text{cm}).$$

In addition, in the above-described formula, V represents an applied voltage of 1000 (volts), S the area of the pole plate 20 ($cm^2$), A the measured electric current value (A), $A_0$an initial electric current value (A) when the applied voltage is 0, and d the thickness of the fine particle layer (cm).

When the above-described volume resistivity is less than $1\times10^{10}$ Ωcm, a phenomenon that the electrostatic charges on the electrostatic latent image holder surface flow to the lateral direction, that is, along the electrostatic latent image holder surface via the inorganic fine particles occurs, whereby the boundary of the electrostatic latent image becomes obscure and it sometime happens that the phenomenon of forming a blurred image is liable to occur. Also, because at transferring, by the injection of a charge caused by the transferring electric field, the charge distribution of the toner is liable to be changed, particularly, when the transfer is carried out plural times using an intermediate transfer material, etc., it sometimes happens that the transfer inferior of the low-charged toner, or the re-transfer of a reverse polarity toner, etc., are liable to occur.

On the other hand, when the volume resistivity exceeds $1\times10^{14}$ Ωcm, it becomes difficult to control the attached amount of the inorganic fine particles in the electrostatic latent image holder surface within the above-described numerical range because the inorganic fine particles are liable to be transferred with the toner, and also it sometimes happens that in the case of adding the inorganic fine particles to the toner and mixing them, the problems of density lowering by excessive charges and the formation of fog by broadening of the charge distribution, etc., are liable to occur.

There is no particular restriction on the method of attaching the inorganic fine particles onto the toner particles, and there are, for example, a method of using a known mixer such a V blender, a Henschel mixer, etc.

It is preferred that the surfaces of the inorganic fine particles are subjected to a hydrophobic treatment with a silane compound, a silicone oil, etc.

There is no particular restriction on the silane compound if a silane compound can control the volume resistivity of the inorganic fine particles and the attaching ratio of the inorganic fine particles to the surfaces of the toner particles within the above-described preferred numerical ranges, but the alkylalkoxy silane represented by following formula (1) and the fluorinated alkylalkoxy silane represented by following formula (2) are suitably used.

$$C_aH_{2a+1}\text{—Si—}(OC_bH_{2b+1})_3 \quad (1)$$

wherein a represents a positive integer and b represents an integer of from 1 to 3.

$$C_nF_{2n+1}CH_3CH_3\text{—Si—}(CH_3)_pX_{3-p} \quad (2)$$

wherein X represents a hydrolyzing group; n represents a positive integer; and p represents 0 or 1.

In the formulae (1) and (2) described above, a and n are usually from 5 to 20, preferably from 7 to 20, and particularly preferably from 10 to 18.

When in the formulae (1) and (2), a and n are smaller than 5, that is, when the alkyl group is too short, the volume resistivity of the inorganic fine particles becomes undesirable lower, on the other hand, when a and n exceed 20, that is, when the alkyl group is too long, it becomes difficult to uniformly carry out the surface treatment of the inorganic fine particles and also, the inorganic fine particles are liable to aggregate to sometimes lower the attaching ratio to the surfaces of the toner particles.

The compounding amount of the silane compound is preferably from 5 to 30 parts by weight, and more preferably from 10 to 20 parts by weight to 100 parts by weight of the inorganic fine particles.

When the compounding amount of the silane compound is less than 5 parts by weight, the volume resistivity of the inorganic fine particles sometimes lowers and on the other hand, when the compounding amount exceeds 30 parts by weight, the volume resistivity of the inorganic fine particles becomes too high and also it sometimes happens that the aggregating property of the inorganic fine particles becomes strong.

The hydrophobic treatment of the inorganic fine particles is usually carried out by a wet treatment in an organic solvent such as an alcohol, toluene, etc., but to unfasten the aggregate of the inorganic fine particles and improve the dispersibility in the toner surface, it is preferred to sufficiently practice wet grinding by a ball mill, a sand grinder, etc., in the case of the hydrophobic treatment.

In particular, when the hydrophobic treating agent having a long chain alkyl group that a and n of the formulae (1) and (2) are from 10 to 18 is used, in the case of the hydrophobic treatment, the viscosity of the solution is increased and the inorganic fine particles are liable to cause aggregation, and thus, the optimization of the viscosity of solution, the kind of the organic solvent, the condition of the wet grinding treatment, etc., becomes necessary.

Also, it is more preferred that after the hydrophobic treatment, dry grinding is carried out by a jet mill, etc.

(Other Components (External Additives))

Other components (external additive) described above include various additives such as a fluidizing agent, a transfer aid, an electrically conductive powder, a lubricant, abrasives, etc.

The fluidizing agent can be added to the toner for the purpose of imparting proper fluidity and charging property to the toner. The fluidizing agent includes in addition to those described inorganic fine powders such as other titanium oxide fine particles than those described in the term of the above-described inorganic fine particles, hydrophobic silica fine particles, alumina fine particles, etc.; an organic fine powder of a fatty acid, the derivatives thereof, metal salts of them, etc.; a resin fine powder of a fluorine-base resin, an acrylic resin, a styrene-base resin, etc.; and the fine powder of cerium oxide, magnetite, etc. They may be used singly or as a mixture of two or more kinds of them.

In particular, to keep a high transfer efficiency, fine particles which are hard to embed in the surfaces of the toner particles by an outside stress receiving in a developing step or a transfer step are preferred. As such fine particles, spherical fine particles which are larger than the average primary particle size of the inorganic fine particles attached to the electrostatic latent image holder surface (i.e., average primary particle size: 30 to 200 nm), and can reduce the contact area with the electrostatic latent image holder of the toner are preferred and in these fine particles, taking into consideration of the control of the charging property of the toner, silica fine particles subjected to a surface hydrophobic treatment are particularly preferred.

The transfer aid described above can be added to the toner for the purpose of assisting the transferring property of the toner.

The conductive powder described above can be added to the toner for the purpose of improving the charge exchanging property.

The lubricant described above can be added to the toner for the purpose of preventing the generation of black spots, white spots, non-printed blank areas, comets, filming, etc., by attaching a toner, external additives, talc, etc., to the electrostatic latent image holder surface.

The toner of the invention may be used as a developer of each of a so-called one-component developing system and a two-component developing system but as described later, it is preferred that the toner is used as a developer of the two-component developing system wherein the toner is combined with a carrier.

There is no particular restriction on the carrier and there are magnetic substance particles themselves such as an iron powder, a ferrite, etc.; a resin-coated type carrier obtained by using the magnetic substance particles as a core material and coating the surface of the core with a known resin such as a styrene-base resin, a vinyl-base resin, a polyester-base resin, a silicone-base resin, etc.; and a dispersion-type carrier formed by dispersing magnetic substance fine particles in a binder resin, etc.

Because, by carrying out an image formation using the toner of the invention, a high toner transfer efficiency can be kept for a long period of time, the amount of the toner to be recovered and wasted is reduced and a stabilized image quality without causing image quality defects such as density lowering, density unevenness, ghosts, fog, etc., can be obtained for a long period of time. Also, without previously attaching the inorganic fine particles to the electrostatic latent image holder surface, from the initial step of the image formation, the average occupied area ratio ($C_{AV}$) of the inorganic fine particles in the electrostatic latent image holder surface and the above-described difference ($C_{MAX}$–$C_{MIN}$) can be easily controlled and stabilized.

[Image-forming Apparatus]

In the image-forming apparatus of the invention, the toner used contains at least toner particles and the inorganic fine particles, and the inorganic fine particles are transferred from the toner to the electrostatic latent image holder surface and attaching thereto as described in the term of the image-forming process of the invention.

Also, the image-forming apparatus of the invention is classified into a 1st image-forming apparatus and a 2nd image-forming apparatus according to whether or not the apparatus has an intermediate transfer member.

The 1st image-forming apparatus of the invention has the electrostatic latent image holder, a developing unit, a transfer unit, and a fixing unit, and, if necessary, has other unit(s). Also, the 2nd image-forming apparatus of the invention has the electrostatic latent image holder surface, a developing unit, a 1st transfer unit, an intermediate transfer member, a 2nd transfer unit, and a fixing unit, and, if necessary, has other unit(s).

(Electrostatic Latent Image Holder)

The material of a photosensitive layer of the electrostatic latent image holder can be properly selected from known materials, for example, various organic materials such as organic photoconductors, etc., and inorganic materials such as amorphous silicon, etc. Also, there is no particular restriction on the form of the electrostatic latent image holder and the form can be properly selected from known forms such as a cylindrical form (such as a drum form, etc.), a belt form, a sheet form, etc.

Also, when, for example, the electrostatic latent image holder is the cylindrical form, from the view points of small-sizing and cost-lowering of the apparatus, the cylinder having a diameter of not larger than 50 mm is suitably used.

There is no particular restriction on the production method of the electrostatic latent image holder, and a known production method of the electrostatic latent image holder can be suitably used. For example, when the electrostatic latent image holder is the cylindrical form, there is a method of extrusion molding a material such as aluminum, an aluminum alloy, SUS, etc., and thereafter applying thereto surface working.

(Developing Unit)

There is no particular restriction on the developing unit if the unit can properly practice the developing step described in the term of the image-forming process, and a known developing device, etc., can be properly used. The developing device may be a monochromatic developing device or a developing device for multicolor images each having a function of developing the electrostatic latent image by contacting or not-contacting the developer with the electrostatic latent image. Also, as the toner used for the developing unit, the toner of the invention described above is preferably used.

(Transfer Unit)

There is no particular restriction on the transfer unit in the 1st image-forming apparatus if the transfer unit can suitably practice the transfer step described in the term of the above-described image-forming process (the step of directly transferring a toner image formed in the electrostatic latent image holder surface onto the surface of a transfer material), and a known transfer charging device, etc., can be used.

(1st Transfer Unit, Intermediate Transfer Member, and 2nd Transfer Unit)

There are no particular restrictions on the 1st transfer unit, the intermediate transfer member, and the 2nd transfer unit in the 2nd image-forming apparatus if they can suitably practice the transfer steps described in the above-described image-forming process (the steps composed of the 1st transfer step of transferring a toner image onto the surface of the intermediate transfer member and the 2nd transfer step of transferring the toner image on the surface of the intermediate transfer member onto the surface of a 2nd transfer member), and known transfer charging devices and intermediate transfer member can be suitably used.

The transfer charging device 1st-transferring the toner image formed on the electrostatic latent image holder surface onto the surface of the intermediate transfer member described below, or 2nd-transferring the toner image transferred onto the surface of the intermediate transfer member onto the surface of the transfer material described below. As the transfer charging device, there is a known transfer charging device, etc., and practically, there are a non-contact type transfer device by corona discharging and a contact-type transfer device such as a transfer belt, a transfer roller, etc.

As the intermediate transfer member, there are, for example, a drum-form intermediate transfer member, a belt-form transfer member, etc., and particularly, in the case of forming a multicolor image, from the view point of small-sizing of the apparatus, a belt-form intermediate transfer member is preferably used.

As the material of the intermediate transfer member, a material which is hard and shows less elongation and shrinkage, and is hard to cause abrasion and attaching is preferred. For example, the material includes known resins such as a polyamide resin, a polyurethane resin, a polyester resin, an epoxy resin, a polycarbonate resin, a polyimide resin, etc. These resins may be used singly or as a mixture of 2 or more kinds of them.

Also, if desired, for the purpose of controlling the resistance, a material composed of a combination of the resin described above with an electrically conductive material such as carbon black, a metallocene compound, an aromatic amine compound, a metal oxide, etc., can be suitably used.

(Fixing Unit)

As the fixing unit, there are known fixing devices such as, for example, a heat roller fixing device, etc. By the action of the fixing device, the toner image on the electrostatic latent image holder surface is strongly fixed onto the transfer material surface.

(Other Units)

As other units, there are an electrostatic latent image forming unit, etc. There is no particular restriction on the electrostatic latent image forming unit if the unit can form an electrostatic latent image on the electrostatic latent image holder surface, and, for example, there are a charging device, a light-exposure device, etc.

The charging device is an apparatus of applying a properly selected voltage on the electrostatic latent image holder surface to electrostatically charge the surface and as the charging device, there are, for example, a contact-type charging device such as a conductive or semi-conductive roll, a brush, a film, a rubber blade, etc., and a non-contact type charging device such as Corotron, Scorotron, etc. The charging device has a function capable of applying a D.C. voltage and/or an A.C. voltage to the electrostatic latent image holder at desired timing, time, strength, etc. From the view point of preventing the generation of ozone, as the charging device, a contact-type charging device is preferred and particularly, from the view points of a low-cost and a stabilization, a charging device of a roll type or a film type is preferred.

The light-exposure device is an apparatus of imagewise-exposing the electrostatically charged electrostatic latent image holder surface corresponding to an image to be formed to form an electrostatic latent image on the electrostatic latent image holder surface, and as the image-exposing device, there are known image-exposure devices of utilizing a known light source such as, for example, a semiconductor laser light, an LED light, a liquid crystal shutter light, etc.

Also, in the image-forming apparatus of the invention, if desired, other units such as a cleaning device, etc., may be properly formed.

FIG. 1 is a schematic view showing an embodiment of the image-forming apparatus of the invention. As shown in the figure, an image-forming apparatus 500 has an electrostatic latent image holder 102, a charging unit 103, a light-exposure unit 104, a developing unit 105, a transfer unit 106, and a static eliminator 108.

On the electrostatic latent image holder 102 is formed an electrostatic latent image by the charging unit 103 and the light-exposure unit 104. The electrostatic latent image becomes a toner image by a developing unit 105. The toner image is transferred onto a transfer material (not shown) such as a paper by the transfer unit 106. After transferring, the charges remained on the electrostatic latent image holder surface are eliminated by the static eliminator 108.

Figure 2:
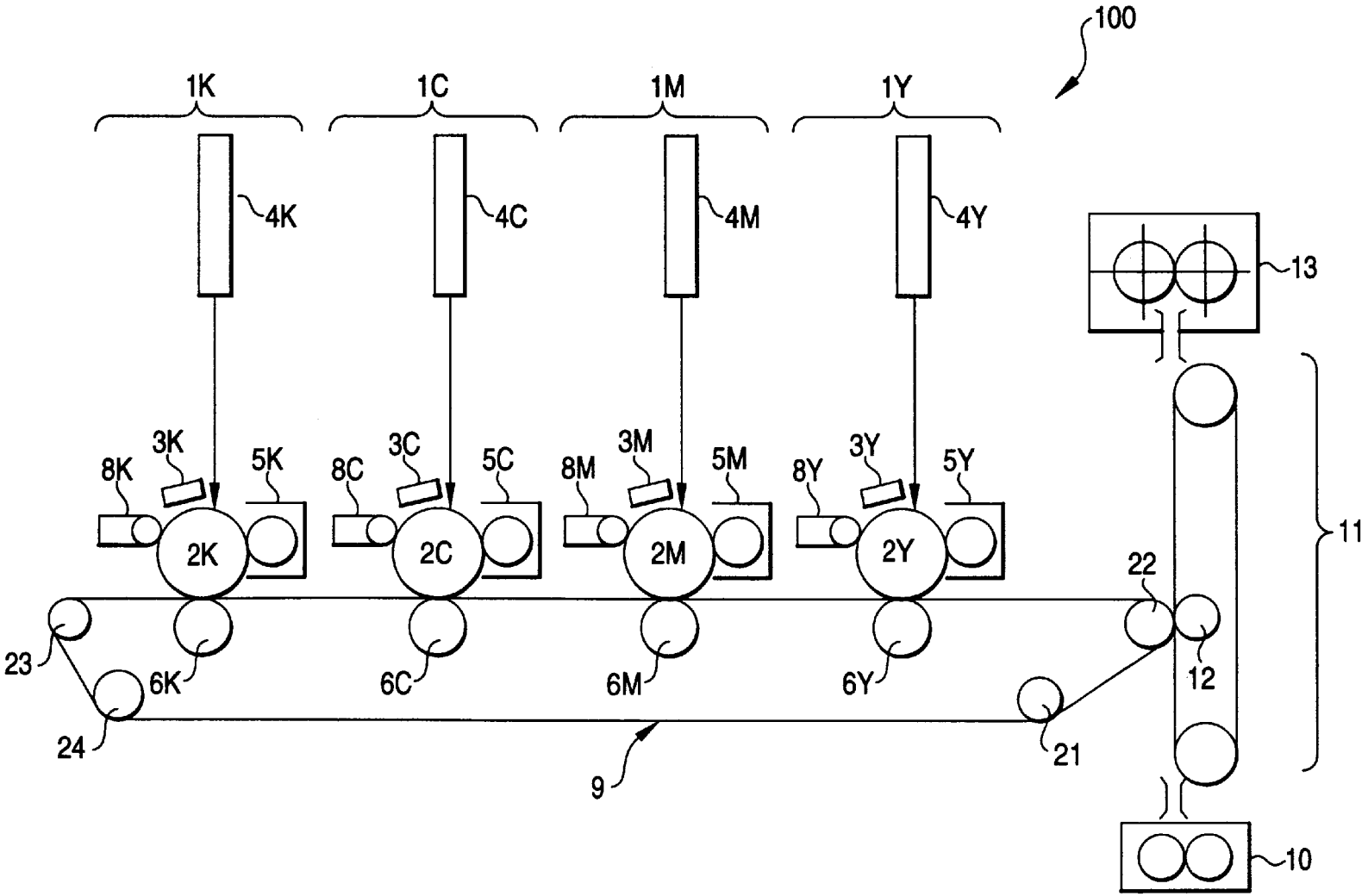
FIG. 2 is a schematic view explaining the image-forming apparatus of a tandem system, which is an embodiment of the image-forming apparatus of the invention.

FIG. 2 is a schematic view showing of the apparatus using the image-forming apparatus of the invention as a tandem system. An image-forming apparatus 100 is equipped with an image-forming unit 1Y, an image-forming unit 1M, an image-forming unit 1C, an image-forming unit 1K, an intermediate transfer member 9, a paper supplier 10, a conveying unit 11, a transfer unit 12 for a 2nd transfer, a fixing unit 13, and supporting rolls 21 to 24.

The image-forming unit 1Y, the image-forming unit 1M, the image-forming unit 1C, and the image-forming unit 1K are units of the image-forming apparatus forming the toner images of the colors of yellow, magenta, cyan, and black, respectively. The image-forming unit 1Y, the image-forming unit 1M, the image-forming unit 1C, and the image-forming unit 1K are disposed in this order in series to the advancing direction of the endless intermediate transfer member 9 mounted on the supporting rolls 21 to 24. Also, the intermediate transfer member 9 passes between an electrostatic latent image holder 2Y, an electrostatic latent image holder 2M, an electrostatic latent image holder 2C, and an electrostatic latent image holder 2K equipped to the image-forming units, respectively and a transfer unit 6Y, a transfer unit 6M, a transfer unit 6C, and a transfer unit 6K disposed facing the electrostatic latent image holders, respectively.

In the image-forming apparatus 100, in the image-forming unit 1Y, the image-forming unit 1M, the image-forming unit 1C, and the image-forming unit 1K, the toner images of the colors of yellow, magenta, cyan, and black are formed, respectively, each toner image is transferred in multilayer state on a transfer material (not shown) on the intermediate transfer material 9 advancing to the direction from the image-forming unit 1Y to the image-forming unit 1K.

According to the image-forming apparatus of the invention, by keeping a high toner transfer efficiency for a long period of time, the amount of the toner to be recovered and wasted is reduced, and further stabilized images without causing image quality defects such as density lowering, density unevenness, ghosts, fog, etc., can be obtained for a long period of time.

Then, the following examples are intended to illustrate the present invention more practically but not to limit the invention in any way.

In addition, in the examples, all "parts", unless otherwise indicated, are "by weight", "Mw" means "a weight average molecular weight", and "Tg" means "a glass transition point".

Preparation of Inorganic Fine Particles (Preparation of Inorganic Fine Particle A)

An ilmenite ore is dissolved in sulfuric acid and after removing an iron component, $TiSO_4$ obtained is hydrolyzed to form $TiO(OH)_2$. After washing $TiO(OH)_2$ obtained with water and filtering, $TiO(OH)_2$ is burned at 700° C. to obtain rutile-type titanium oxide fine particles (average primary particle size: 20 nm).

The titanium oxide fine particles obtained are dispersed in a toluene solvent, after adding thereto 15 parts of decyltrimethoxysilane to 100 parts of the titanium oxide fine particles, the mixture is wet-ground for 20 minutes using a sand grinder to unbind the aggregate of the fine particles, and the titanium oxide fine particles are heat-dried by a press kneader to carry out a hydrophobic treatment.

Furthermore, the titanium oxide fine particles are ground using a jet mill to obtain an inorganic fine particle A (hydrophobic titanium oxide fine particles, average primary particle size: 20 nm, volume resistivity: $2\times10^{12}$ Ωcm).

(Preparation of Inorganic Fine Particle B)

By following the same procedure as the preparation of the inorganic fine particle A except that octadecyltrimethoxysilane is used in place of decyltrimethoxysilane, an inorganic fine particle B (titanium oxide fine particles, average primary particle size: 20 nm, volume resistivity: $3\times10^{13}$ Ωcm) is obtained.

(Preparation of Inorganic Fine Particle C)

By following the same procedure as the preparation of the inorganic fine particle A except that a methanol solvent is used in place of the toluene solvent, isobutyltrimethoxysilane is used in place of decyltrimethoxysilane, wet-grinding for 20 minutes is changed to a wet-grinding for 5 minutes, and after the hydrophobic treatment, a step of grinding by a pin mill is formed, an inorganic fine particle C (hydrophobic titanium oxide fine particles, average primary particle size: 20 nm, volume resistivity: $1\times10^{9}$ Ωcm) is obtained.

(Preparation of Inorganic Fine Particle D)

By following the same procedure as the preparation of the inorganic fine particle C except that 20 parts of octadecyltrimethoxysilane is used in place of 15 parts of isobutyltrimethoxysilane, an inorganic fine particle D (titanium oxide fine particles, average primary particle size: 20 nm, volume resistivity: $4\times10^{13}$ Ωcm) is obtained.

(Preparation of Inorganic Fine Particle E)

By the same manner of preparing $TiO(OH)_2$ in the preparation of the inorganic fine particle A, $TiO(OH)_2$ is prepared. After mixing 100 parts of $TiO(OH)_2$ obtained with 40 parts of decyltrimethoxysilane, the reaction is carried out by heating. Thereafter, the product is washed with water, filtered, and dried at 120° C., then, soft aggregates are unbound using a pin mill, and further the product is ground using a jet mill to provide an inorganic fine particle E (metatianic acid fine particles, average primary particle size: 20 nm, specific gravity: 3.2, volume resistivity: $1\times10^{11}$ Ωcm).

Preparation of Toner Particles (Preparation of Cyan Toner Particles)

Preparation of Binder Resin Dispersion:

A styrene-butyl acrylate-acrylic acid copolymer (copolymerization ratio (styrene/butyl acrylate/acrylic acid)=82/18/2, Mw=23000, Tg=65° C.) is used as a binder resin, and 400 parts of the binder resin are mixed and dispersed in a solution obtained by dissolving 6 parts of a nonionic surface active agent and 10 parts of an anionic surface active agent in 600 parts of ion-exchanged water to prepare a binder resin dispersion.

Preparation of Pigment Dispersion 1:

C.I. pigment Blue 15:3 is used as a pigment, and 20 parts of the pigment are dispersed in a mixture of 1.5 parts of an anionic surface active agent and 78.5 parts of ion-exchanged water to prepare a pigment dispersion 1.

Preparation of Toner Particles:

The binder resin dispersion 100 parts

Pigment dispersion 112 parts

Cationic surface active agent (Sanizol C, made by Kao Corporation) 0.6 part

The above-described components are placed in a round stainless steel-made flask and the components are mixed and dispersed using Ultra Talax T50 (manufactured by IKA, Inc.) to provide a dispersion. Thereafter, while stirring, the dispersion is heated to 50° C. by a heating oil bath and the dispersion is kept at the temperature for 60 minutes to obtain the dispersion having dispersed therein aggregated particles having an average aggregated particle size of 4.5 μm. Furthermore, the temperature of the above-described heating oil bath containing the dispersion is raised to 52° C. and the oil bath is kept at the temperature for one hour to provide the dispersion having dispersed therein aggregated particles having an average aggregate particle size of 5.0 μm.

Thereafter, after adding 1 part of an anionic surface active agent (Neogen RK, made by DAI-ICHI KOGYO SEIYAKU CO., LTD) to the dispersion obtained, the above-described flask is closed, the flask is heated to 97° C. while stirring the dispersion using a magnetic force seal, and the dispersion is kept at the temperature for 4 hours. Thereafter, the dispersion is cooled to provide the dispersion having dispersed therein fine particles having an average particle size of 6.1 μm.

From the dispersion obtained, the fine particles are recovered by filtration and washed 3 times with ion-exchanged water. The particles obtained are dispersed in 5 liters of ion-exchanged water, after adding thereto an aqueous solution of 1N sodium hydroxide to adjust pH 9.5, the dispersion is placed again in the above-described flask, the flask is heated to 80° C. using a heating oil bath while stirring, and then the flask is kept at the temperature for 2 hours.

Thereafter, the particles are recovered again by filtration, after washing the particles 3 times with ion-exchanged water, the particles are vacuum-dried for 10 hours and classified to prepare cyan toner mother particles having a volume average particle size (D50) of 6.2 μm and a sphericity of 115.

(Preparation of Magenta Toner Particles)

Preparation of Pigment Dispersion 2:

C.I. Pigment Red 57:1 is used as a pigment and 20 parts of the pigment are dispersed in a mixture of 1.5 parts of an anionic surface active agent and 78.5 parts of ion-exchanged water to prepare a pigment dispersion 2.

Preparation of Magenta Toner Particles:

By following the same procedure as the preparation of the cyan toner particles except that 15 parts of the pigment dispersion 2 is used in place of 12 parts of the pigment dispersion 1, a magenta toner particles having a volume average particle size (D50) of 6.4 μm and a sphericity of 118 are prepared.

(Preparation of Yellow Toner Particles)

Preparation of Pigment Dispersion 3:

C.I. Pigment Yellow 180 is used as a pigment and 20 parts of the pigment is dispersed in a mixture of 1.5 parts of an anionic surface active agent and 78.5 parts of ion-exchanged water to prepare a pigment dispersion 3.

Preparation of Yellow Toner Particles:

By following the same procedure as the preparation of the cyan toner particles except that 10 parts of the pigment dispersion 3 are used in place of 12 parts of the pigment dispersion 1, a yellow toner particles having a volume average particle size (D50) of 6.6 μm and a sphericity of 116 are prepared.

(Preparation of Black Toner Particles)

Preparation of Pigment Dispersion 4:

Carbon black is used as a pigment and 20 parts of the pigment are dispersed in a mixture of 1.5 parts of an anionic surface active agent and 78.5 parts of ion-exchanged water to prepare a pigment dispersion 4.

Preparation of Black Toner Particles:

By following the same procedure as the preparation of the cyan toner particles except that 4 parts of the pigment dispersion 4 are used in place of 12 parts of the pigment dispersion 1, a black toner particles having a volume average particle size (D50) of 6.5 μm and a sphericity of 111 are prepared.

[Preparation of Carrier]

By coating 100 parts of carrier core F35 (Cu-Zn ferrite, made by Powdertec, Inc.) with 3 parts of PMMA using a press kneader and the coated particles are sieved to prepare a resin-coated carrier having a volume average particle size (D50) of 35 μm.

EXAMPLE 1

Reparation of Toners

Preparation of Cyan Toner

After stirring (stirring blade rotation number: 13000 rpm.) and mixing 50 g of the above-described cyan toner particles and 0.4 g of the inorganic fine particle A using a sample mill (Type SK-M10, manufactured by Kyoritsu Riko K.K.) for 30 seconds, 0.6 g of silicone oil-treated silica (RY50, average primary particle size: 40 nm, made by Nippon Aerosil Co., Ltd.) is added to the mixture, and after further stirring (stirring blade rotation number: 13000 rpm.) and mixing for 30 seconds, the mixture obtained is sieved at 45 μm using a pneumatic sieving machine to prepare a cyan toner.

When the covering ratio ($C_0$) and the covering ratio (C) of the cyan toner obtained, and the attached ratio ($C/C_0$) of the inorganic fine particle A onto the surfaces of the toner particles are measured and calculated by the methods described above, the covering ratio ($C_0$) is 17.9% and the covering ratio (C) is 14.7%, and as the results, the attached ratio ($C/C_0$) of the inorganic fine particle A onto the surfaces of the toner particles is 0.82.

Also, when the ratio of the inorganic fine particle A weakly attached to the cyan toner particles and the ratio of the inorganic fine particle A strongly attached thereto are measured and calculated by the methods described above, the ratio of the inorganic fine particle A weakly attached is 16% and the ratio of the inorganic fine particle A strongly attached is 62%.

Preparation of Magenta Toner

By following the same procedure as the preparation of the cyan toner except that 50 g of the magenta toner particles are used in place of 50 g of the cyan toner particles, a magenta toner is prepared. Also, when the covering ratio ($C_0$), the covering ratio (C), the attached ratio ($C/C_0$) of the inorganic fine particle A onto the surfaces of the toner particles, the ratio of the inorganic fine particle A weakly attached to the magenta toner particles and the ratio of the inorganic fine particle A strongly attached thereto are similarly measured and calculated, the covering ratio ($C_0$) is 18.5%, the covering ratio (C) is 15.4%, the attached ratio ($C/C_0$) is 0.83, the ratio of the inorganic fine particle A weakly attached is 12% and the ratio of the inorganic fine particle A strongly attached is 66%.

Preparation of Yellow Toner

By following the same procedure as the preparation of the cyan toner except that 50 g of the yellow toner particles are used in place of 50 g of the cyan toner particles, a yellow toner is prepared. Also, when the covering ratio ($C_0$), the covering ratio (C), the attached ratio ($C/C_0$) of the inorganic fine particle A onto the surfaces of the toner particles, the ratio of the inorganic fine particle A weakly attached to the yellow toner particles and the ratio of the inorganic fine particle A strongly attached thereto are similarly measured and calculated, the covering ratio ($C_0$) is 19.1%, the covering ratio (C) is 15.5%, the attached ratio ($C/C_0$) is 0.81, the ratio of the inorganic fine particle A weakly attached is 14% and the ratio of the inorganic fine particle A strongly attached is 66%.

Preparation of Black Toner

By following the same procedure as the preparation of the cyan toner except that 50 g of the black toner particles are used in place of 50 g of the cyan toner particles, a black toner is prepared. Also, when the covering ratio ($C_0$), the covering ratio (C), the attached ratio ($C/C_0$) of the inorganic fine particle A onto the surfaces of the toner particles, the ratio of the inorganic fine particle A weakly attached to the black toner particles and the ratio of the inorganic fine particle A strongly attached thereto are similarly measured and calculated, the covering ratio ($C_0$) is 18.8%, the covering ratio (C) is 16.2%, the attached ratio ($C/C_0$) is 0.86, the ratio of the inorganic fine particle A weakly attached is 18% and the ratio of the inorganic fine particle A strongly attached is 68%.

Preparation of Developers

By mixing 18 parts of each of the cyan toner, the magenta toner, the yellow toner, and the black toner obtained with 100 parts of the resin-coated carrier by a V-type blender, each of a cyan developer, a magenta developer, a yellow developer, and a black developer is prepared, respectively.

Measurement·Evaluation

Using each of the developers obtained, the following measurements and the image-quality evaluation are carried out using the image-forming apparatus 1 shown in FIG. 1. The results are shown in Table 1 below.

Measurement of Average Occupied Ratio ($C_{AV}$)

The above-described average occupied ratio ($C_{AV}$) is measured as follows. That is, by the above-described method of measuring the average occupied area ratio ($C_{AV}$) of the inorganic fine particles, using an X-ray photoelectronic spectroscope (JPS-9000MX, manufactured by JEOL LTD.), in the case of carrying out the image formation on 1000 sheets and 30000 sheets of transfer materials (L papers, manufactured by FUJI XEROX CO., LTD., A4 size) in the lengthwise direction, each signal intensity is measured and calculated.

In addition, the above-described image formation is carried out using each full color image (each color 8% printed ratio) including each solid portion (100% input density) of 2×2 cm of a primary color of yellow, magenta, cyan, and black, a secondary color of red, green, and blue, and a tertiary color of process black, and a letter portion.

Measurement of Difference ($C_{MAX}-C_{MIN}$)

The above-described difference ($C_{MAX}-C_{MIN}$) is calculated by the 1st calculation method in the two kinds of the calculation methods described above, by calculating the maximum occupied area ratio ($C_{MAX}$) and the minimum occupied area ratio ($C_{MIN}$), by the measured value of each signal intensity in the case of carrying out the image formation onto 1000 sheets and 30000 sheets of the above-described transfer materials (A4 size).

Measurement·calculation of Ratio (a2/a1)

The ratio (a2/a1) is calculated by observing the electrostatic latent image holder surface after the above-described image formation by an electron microscope (SEM) at 30,000 magnifications and measuring the average primary particle size (a1) and the average aggregated particle size (a2) of the inorganic fine particles transferred and attached to the electrostatic latent image holder surface.

Evaluations of Image Density and Fog

Using a chart including a solid portion of 2 cm×2 cm and a letter portion to the above-described transfer material (A4 size), the image density and fog are evaluated.

Evaluation of Image Density

Each image density of the solid portion of a primary color (yellow, magenta or cyan) is measured using a densitometer (X-rite 404A, manufactured by X-rite Inc.), and the result is evaluated by the following standards.

Evaluation Standard

○ Image density of at least 1.3

Δ Image density of 1.1 to 1.3

× Image density of lower than 1.1

Evaluation of Fog

The surface of a paper for full color background portion is observed by a magnifier of 50 magnifications and the result is visually evaluated by the following standards.

Evaluation Standard

○ No fog is observed.

Δ Fog is observed a little.

× Fog is considerably observed.

Evaluations of Transfer Ghost and Halftone Ghost

After continuously image forming on 5000 sheets of the above-described transfer materials (A4 size), a halftone (20% input density) is printed and the result is evaluated by the following standards using the above-described chart. The results are shown in Table 1.

Evaluation of Transfer Ghost

○ No ghost is observed.

Δ Ghost is observed a little.

× Ghost is clearly observed.

Evaluation of Halftone Ghost

○ No ghost is observed.

Δ Ghost is observed a little.

× Ghost is clearly observed.

EXAMPLE 2

Preparation of Toner

By following the same procedures as the preparation of the toner in Example 1 except that the inorganic fine particle B is used in place of the inorganic fine particle A, a cyan toner, a magenta toner, a yellow toner, and a black toner are obtained, and as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particles strongly attached thereto are similarly measured and calculated.

The covering ratio ($C_0$) is 17.9% for the cyan toner, 18.5% for the magenta toner, 19.1% for the yellow toner, and 18.8% for the black toner.

The covering ratio (C) is 13.4% for the cyan toner, 14.2% for the magenta toner, 13.4% for the yellow toner, and 13.7% for the black toner.

The attached ratio ($C/C_0$) of the inorganic fine particles onto the surfaces of the toner particles is 0.75 for the cyan toner, 0.77 for the magenta toner, 0.70 for the yellow toner, and 0.73 for the black toner.

The ratio of the inorganic fine particles weakly attached to the toner particles is 22% for the cyan toner, 20% for the magenta toner, 25% for the yellow toner, and 28% for the black toner and the ratio of the inorganic fine particles strongly attached to the toner particles is 58% for the cyan toner, 60% for the magenta toner, 61% for the yellow toner, and 58% for the black toner.

Preparation of Developer

By following same procedures as the preparation of the developers in Example 1 except that the cyan toner, the magenta toner, the yellow toner, and the black toner of obtained in the toner preparation of Example 2 are used in place of the cyan toner, the magenta toner, the yellow toner, and the black toner of obtained in the toner preparation of Example 1, a cyan developer, a magenta developer, a yellow developer, and a black developer are prepared, respectively.

Measurement·Evaluation

Using the developers obtained, the measurements and the evaluations are carried out by the same manners as in the measurements and the evaluations in Example 1. The results are shown in Table 1 below.

EXAMPLE 3

Preparation of Toner

Preparation of Cyan Toner

After stirring (stirring blade rotation number: 13000 rpm.) and mixing 50 g of the above-described cyan toner mother particles and 0.65 g of the inorganic fine particle A using a sample mill (Type SK-M10, manufactured by Kyoritsu Riko K.K.) for one minute, 0.7 g of silicone oil-treated silica (RY50, average primary particle size: 40 nm, made by Nippon Aerosil Co., Ltd.) is added to the mixture, and after further stirring (stirring blade rotation number: 13000 rpm.) and mixing for 30 seconds, the mixture obtained is sieved at 45 $\mu$m using a pneumatic sieving machine to prepare a cyan toner.

Preparation of Magenta Toner

By following the same procedure as in the above-described preparation of the cyan toner except that 50 g of the magenta toner particles are used in place of 50 g of the cyan toner particles, a magenta toner is prepared.

Preparation of Yellow Toner

By following the same procedure as in the above-described preparation of the cyan toner except that 50 g of the yellow toner particles are used in place of 50 g of the cyan toner particles, a yellow toner is prepared.

Preparation of Black Toner

By following the same procedure as in the above-described preparation of the cyan toner except that 50 g of the black toner particles are used in place of 50 g of the cyan toner particles, a black toner is prepared.

About each of the toners obtained, as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 29.2% for the cyan toner, 30.1% for the magenta toner, 31.0% for the yellow toner, and 30.6% for the black toner.

The covering ratio (C) is 23.4% for the cyan toner, 25.0% for the magenta toner, 24.5% for the yellow toner, and 24.8% for the black toner.

The attached ratio ($C/C_0$) of the inorganic fine particles onto the surfaces of the toner particles is 0.80 for the cyan toner, 0.83 for the magenta toner, 0.79 for the yellow toner, and 0.81 for the black toner.

The ratio of the inorganic fine particles weakly attached to the toner particles is 31% for the cyan toner, 28% for the magenta toner, 33% for the yellow toner, and 30% for the black toner and the ratio of the inorganic fine particles strongly attached to the toner particles is 50% for the cyan toner, 48% for the magenta toner, 48% for the yellow toner, and 45% for the black toner.

Preparation of Developer

By following same procedures as the preparation of the developers in Example 1 except that the cyan toner, the magenta toner, the yellow toner, and the black toner obtained in the toner preparation of Example 3 are used in place of the cyan toner, the magenta toner, the yellow toner, and the black toner of obtained in the toner preparation of Example 1, a cyan developer, a magenta developer, a yellow developer, and a black developer are prepared, respectively.

Measurement·Evaluation

Using the developers obtained, the measurements and the evaluations are carried out by the same manners as in the measurements and the evaluations in Example 1. The results are shown in Table 1 below.

EXAMPLE 4

Preparation of Toner

By following the same procedure as the preparation of the toners in Example 1 except that 0.35 g of the inorganic fine particle E is used in place of 0.4 g of the inorganic fine particle A, a cyan toner, a magenta toner, a yellow toner, and a black toner are prepared.

About the toners obtained, as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 19.6% for the cyan toner, 20.3% for the magenta toner, 20.9% for the yellow toner, and 20% for the black toner.

The covering ratio (C) is 17.2% for the cyan toner, 17.3% for the magenta toner, 18.0% for the yellow toner, and 17.1% for the black toner.

The attached ratio ($C/C_0$) of the inorganic fine particles onto the surfaces of the toner particles is 0.88 for the cyan toner, 0.85 for the magenta toner, 0.86 for the yellow toner, and 0.83 for the black toner.

The ratio of the inorganic fine particles weakly attached to the toner particles is 10% for the cyan toner, 8% for the magenta toner, 7% for the yellow toner, and 11% for the black toner and the ratio of the inorganic fine particles strongly attached to the toner particles is 70% for the cyan toner, 69% for the magenta toner, 72% for the yellow toner, and 70% for the black toner.

Preparation of Developer

By following same procedures as the preparation of the developers in Example 1 except that the cyan toner, the magenta toner, the yellow toner, and the black toner obtained in the toner preparation of Example 4 are used in place of the cyan toner, the magenta toner, the yellow toner, and the black toner of obtained in the toner preparation of Example 1, a cyan developer, a magenta developer, a yellow developer, and a black developer are prepared, respectively.

Evaluation of Image Quality

Using the developers obtained, the measurements and the evaluations are carried out by the same manners as in the measurements and the evaluations in Example 1. The results are shown in Table 1 below.

TABLE 1

| | | a2/a1 | | $C_{AV}$ | | $C_{MAX}-C_{MIN}$ | | | | | |
|---|---|---|---|---|---|---|---|---|---|---|---|
| Examples | Developer | After 1,000 sheets | After 30,000 sheets | After 1,000 sheets | After 30,000 sheets | After 1,000 sheets | After 30,000 sheets | Image density | Fog | Transfer ghost | Halftone ghost |
| Example 1 | C | 2.2 | 1.7 | 4.0 | 7.5 | 1.2 | 2.8 | ○ | ○ | ○ | ○ |
| | M | 2.1 | 2.0 | 3.5 | 7.0 | 1.1 | 3.0 | ○ | ○ | ○ | ○ |
| | Y | 2.1 | 1.9 | 3.8 | 7.0 | 1.0 | 2.6 | ○ | ○ | ○ | ○ |
| | B | 2.0 | 1.5 | 3.3 | 6.8 | 1.3 | 2.9 | ○ | ○ | ○ | ○ |
| Example 2 | C | 2.8 | 2.3 | 4.2 | 9.5 | 2.0 | 3.2 | ○ | ○ | ○ | ○ |
| | M | 2.4 | 2.1 | 4.3 | 8.0 | 1.6 | 3.0 | ○ | ○ | ○ | ○ |
| | Y | 2.5 | 2.2 | 4.4 | 8.8 | 1.5 | 2.8 | ○ | ○ | ○ | ○ |
| | B | 2.5 | 2.0 | 4.5 | 9.8 | 1.9 | 2.9 | ○ | ○ | ○ | ○ |
| Example 3 | C | 3.0 | 2.2 | 4.2 | 10.0 | 3.1 | 4.0 | ○ | ○ | ○ | ○ |
| | M | 3.0 | 1.8 | 4.5 | 11.5 | 2.9 | 4.2 | ○ | ○ | ○ | ○ |
| | Y | 2.8 | 2.6 | 4.0 | 13.2 | 3.3 | 4.8 | ○ | ○ | ○ | Δ |
| | B | 3.0 | 2.0 | 4.5 | 12.8 | 3.9 | 4.9 | ○ | ○ | ○ | Δ |
| Example 4 | C | 1.9 | 1.5 | 3.8 | 7.7 | 1.1 | 2.3 | ○ | ○ | ○ | ○ |
| | M | 2.1 | 1.3 | 3.6 | 6.2 | 1.4 | 2.8 | ○ | ○ | ○ | ○ |
| | Y | 2.3 | 1.9 | 3.8 | 6.8 | 1.7 | 3.3 | ○ | ○ | ○ | ○ |
| | B | 2.5 | 2.0 | 4.0 | 7.5 | 1.3 | 2.2 | ○ | ○ | ○ | ○ |

In addition, in Table 1, C means a cyan developer, M a magenta developer, Y a yellow developer, and B a black developer.

COMPARATIVE EXAMPLE 1

Preparation of Toner

Preparation of Cyan Toner

After compounding 50 g of the above-described cyan toner mother particles, 0.8 g of the inorganic fine particle A, and 0.8 g of silicone oil-treated silica (RY50, average primary particle size: 40 nm, made by Nippon Aerosil Co., Ltd.) and stirring (stirring blade rotation number: 13000 rpm.) the mixture using a sample mill (Type SK-M10, manufactured by Kyoritsu Riko K.K.) for 15 seconds, the mixture obtained is sieved at 45 μm using a pneumatic sieving machine to prepare a cyan toner.

Preparation of Magenta Toner

By following the same procedure as the preparation of the cyan toner described above except that 50 g of the magenta toner particles are used in place of 50 g of the cyan toner particles, a magenta toner is prepared.

Preparation of Yellow Toner

By following the same procedure as the preparation of the cyan toner described above except that 50 g of the yellow toner particles are used in place of 50 g of the cyan toner particles, a yellow toner is prepared.

Preparation of Black Toner

By following the same procedure as the preparation of the cyan toner described above except that 50 g of the black toner mother particles are used in place of 50 g of the cyan toner mother particles, a black toner is prepared.

About each of the toners obtained, as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 35.9% for the cyan toner, 37.0% for the magenta toner, 38.2% for the yellow toner, and 37.6% for the black toner.

The covering ratio (C) is 23.7% for the cyan toner, 25.2% for the magenta toner, 26.7% for the yellow toner, and 25.2% for the black toner.

The attached ratio ($C/C_0$) of the inorganic fine particles onto the surfaces of the toner mother particles is 0.66 for the cyan toner, 0.68 for the magenta toner, 0.70 for the yellow toner, and 0.67 for the black toner.

The ratio of the inorganic fine particles weakly attached to the toner particles is 45% for the cyan toner, 48% for the magenta toner, 50% for the yellow toner, and 51% for the black toner and the ratio of the inorganic fine particles strongly attached to thereto is 20% for the cyan toner, 18% for the magenta toner, 17% for the yellow toner, and 22% for the black toner.

Preparation of Developer

By following the same procedure as the preparation of the developers in Example 1 except that the cyan toner, the magenta toner, and yellow toner, and the black toner obtained in the toner preparation in Comparative Example 1 are used in place of the cyan toner, the magenta toner, and yellow toner, and the black toner obtained in the toner preparation in Example 1, a cyan developer, a magenta developer, a yellow developer and a black developer are prepared, respectively.

Measurement·Evaluation

Using the developers obtained, the measurements and the evaluations as in the measurements and the evaluations in Example 1 are carried out. The results are shown in Table 2 below.

COMPARATIVE EXAMPLE 2

Preparation of Toner

By following the same procedure as the toner preparation in Example 1 except that the addition amount of the inorganic fine particle A is changed to 0.25 g and the stirring and mixing time by the sample mill (Type SK-M 10, manufactured by Kyoritsu Riko K.K.) in the step before adding silicone oil-treated silica (RY50, average primary particle size: 40 nm, made by Nippon Aerosil Co., Ltd.) is changed to 120 seconds, a cyan toner, a magenta toner, a yellow toner, and a black toner are obtained, and as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 11.2% for the cyan toner, 11.6% for the magenta toner, 11.9% for the yellow toner, and 11.8% for the black toner.

The covering ratio (C) is 10.8% for the cyan toner, 11.3% for the magenta toner, 11.7% for the yellow toner, and 11.3% for the black toner.

The attached ratio ($C/C_0$) of the inorganic fine particles onto the surfaces of the toner particles is 0.96 for the cyan toner, 0.97 for the magenta toner, 0.98 for the yellow toner, and 0.96 for the black toner.

The ratio of the inorganic fine particles weakly attached to the toner particles is 2% for the cyan toner, 6% for the magenta toner, 3% for the yellow toner, and 4% for the black toner and the ratio of the inorganic fine particles strongly attached to the toner particles is 85% for the cyan toner, 88% for the magenta toner, 89% for the yellow toner, and 86% for the black toner.

Preparation of Developer

By following the same procedure as the preparation of the developers in Example 1 except that the cyan toner, the magenta toner, and yellow toner, and the black toner obtained in the toner preparation in Comparative Example 2 are used in place of the cyan toner, the magenta toner, and yellow toner, and the black toner obtained in the toner preparation in Example 1, a cyan developer, a magenta developer, a yellow developer and a black developer are prepared, respectively.

Measurement·Evaluation

Using the developers obtained, the measurements and the evaluations as in the measurements and the evaluations in Example 1 are carried out. The results are shown in Table 2 below.

COMPARATIVE EXAMPLE 3

Preparation of Toner

By following the same procedure as the toner preparation in Example 1 except that the inorganic fine powder C is used in place of the inorganic fine particle A, a cyan toner, a magenta toner, a yellow toner, and a black toner are obtained, and as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 17.9% for the cyan toner, 18.5% for the magenta toner, 19.1% for the yellow toner, and 18.8% for the black toner.

The covering ratio (C) is 10.4% for the cyan toner, 10.4% for the magenta toner, 11.3% for the yellow toner, and 10.3% for the black toner.

The attached ratio ($C/C_0$) of the inorganic fine particles onto the surfaces of the toner particles is 0.58 for the cyan toner, 0.56 for the magenta toner, 0.59 for the yellow toner, and 0.55 for the black toner.

The ratio of the inorganic fine particles weakly attached to the toner particles is 25% for the cyan toner, 20% for the magenta toner, 27% for the yellow toner, and 30% for the black toner and the ratio of the inorganic fine particles strongly attached to the toner particles is 50% for the cyan toner, 53% for the magenta toner, 51% for the yellow toner, and 55% for the black toner.

Preparation of Developer

By following the same procedure as the preparation of the developers in Example 1 except that the cyan toner, the magenta toner, and yellow toner, and the black toner obtained in the toner preparation in Comparative Example 3 are used in place of the cyan toner, the magenta toner, and yellow toner, and the black toner obtained in the toner preparation in Example 1, a cyan developer, a magenta developer, a yellow developer and a black developer are prepared, respectively.

Measurement·evaluation

Using the developers obtained, the measurements and the evaluations as in the measurements and the evaluations in Example 1 are carried out. The results are shown in Table 2 below.

COMPARATIVE EXAMPLE 4

By following the same procedure as the toner preparation in Example 1 except that the inorganic fine particles D is used in place of the inorganic fine particle A, a cyan toner, a magenta toner, a yellow toner, and a black toner are obtained, and as in Example 1, the covering ratio ($C_0$), the covering ratio (C), the attached ratio ($C/C_0$) of the inorganic fine particles onto the surfaces of the toner particles, the ratio of the inorganic fine particles weakly attached to the toner particles and the ratio of the inorganic fine particle strongly attached thereto are similarly measured and calculated.

The covering ratio ($C_0$) is 17.9% for the cyan toner, 18.5% for the magenta toner, 19.1% for the yellow toner, and 18.8% for the black toner.

The covering ratio (C) is 4.5% for the cyan toner, 5.2% for the magenta toner, 4.2% for the yellow toner, and 5.1% for the black toner.

The attached ratio ($C/C_0$) of the inorganic fine particles onto the surfaces of the toner particles is 0.25 for the cyan toner, 0.28 for the magenta toner, 0.22 for the yellow toner, and 0.27 for the black toner.

The ratio of the inorganic fine particles weakly attached to the toner particles is 44% for the cyan toner, 50% for the magenta toner, 48% for the yellow toner, and 52% for the black toner and the ratio of the inorganic fine particles strongly attached to the toner particles is 18% for the cyan toner, 10% for the magenta toner, 17% for the yellow toner, and 15% for the black toner.

Preparation of Developer

By following the same procedure as the preparation of the developers in Example 1 except that the cyan toner, the magenta toner, and yellow toner, and the black toner obtained in the toner preparation in Comparative Example 4 are used in place of the cyan toner, the magenta toner, and yellow toner, and the black toner obtained in the toner preparation in Example 1, a cyan developer, a magenta developer, a yellow developer and a black developer are prepared, respectively.

Measurement·Evaluation

Using the developers obtained, the measurements and the evaluations as in the measurements and the evaluations in Example 1 are carried out. The results are shown in Table 2 below.

TABLE 2

| | | a2/a1 | | $C_{AV}$ | | $C_{MAX}-C_{MIN}$ | | | | | |
|---|---|---|---|---|---|---|---|---|---|---|---|
| Examples | Developer | After 1,000 sheets | After 30,000 sheets | After 1,000 sheets | After 30,000 sheets | After 1,000 sheets | After 30,000 sheets | Image density | Fog | Transfer ghost | Halftone ghost |
| Comparative Example 1 | C | 3.1 | 2.5 | 15.5 | 26.5 | 7.2 | 10.8 | ○ | ○ | ○ | x negative |
| | M | 3.3 | 2.8 | 13.8 | 23.0 | 6.8 | 8.9 | ○ | ○ | ○ | x negative |
| | Y | 3.5 | 2.9 | 14.5 | 24.5 | 8.0 | 10.5 | ○ | ○ | ○ | x negative |
| | B | 2.7 | 2.6 | 15.0 | 22.5 | 5.9 | 9.0 | ○ | ○ | ○ | x negative |
| Comparative Example 2 | C | 2.0 | 1.4 | 0.5 | 0.6 | 0.4 | 0.2 | x | ○ | x | ○ |
| | M | 1.9 | 1.6 | 0.8 | 0.6 | 0.5 | 0.0 | x | ○ | x | ○ |
| | Y | 1.7 | 1.5 | 0.7 | 0.7 | 0.7 | 0.5 | x | ○ | x | ○ |
| | B | 2.2 | 1.8 | 0.7 | 0.4 | 0.2 | 0.1 | x | ○ | x | ○ |
| Comparative Example 3 | C | 5.2 | 4.4 | 10.2 | 18.8 | 6.0 | 6.6 | ○ | ○ | Δ | x negative |
| | M | 5.5 | 5.5 | 11.8 | 20.0 | 5.2 | 6.0 | ○ | ○ | Δ | x negative |
| | Y | 5.1 | 5.3 | 10.9 | 19.8 | 5.1 | 5.8 | ○ | ○ | Δ | x negative |
| | B | 5.1 | 5.1 | 12.8 | 22.5 | 5.3 | 5.9 | ○ | ○ | Δ | x negative |
| Comparative Example 4 | C | 10.0 | 8.8 | 21.0 | 38.5 | 11.0 | 15.5 | Δ | ○ | x | x negative |
| | M | 9.3 | 8.0 | 26.5 | 42.2 | 8.8 | 18.8 | Δ | ○ | x | x negative |
| | Y | 8.2 | 7.0 | 23.0 | 39.9 | 9.5 | 13.9 | Δ | ○ | x | x negative |
| | B | 10.2 | 9.0 | 27.0 | 47.8 | 10.8 | 20.5 | Δ | ○ | x | x negative |

In addition, in Table 2, C means a cyan developer, M a magenta developer, Y a yellow developer, and B a black. developer.

As described above, Examples 1 to 4, the image density is stabilized in each environment for a long period of time, and images having high image quality can be obtained without causing a transfer ghost and fog, and without generating defects such as a low density of halftone, a density unevenness, ghosts, white spots, black spots.

On the other hand, in Comparative Example 1, the image density is stabilized and a transfer ghost and fog are not formed, but when the number of printed sheets exceeds 5,000 sheets, density lowering of halftone, and a negative ghost of not printing a solid portion of 2×2 cm occur.

In Comparative Example 2, from the initial step of the image formation, a transfer ghost generates, and with the increase of the number of printing sheets, the image density is lowered and the occurrence of a transfer ghost becomes severe.

In Comparative Example 3, the image density is stabilized but when the number of the printed sheets exceeds 200 sheets, an image blur considered to be caused by latent image flowing and a transfer ghost by inferior transfer occur, and with the increase of the number of printed sheets, the occurrence of the transfer ghost becomes severe. Also, when the number of the printed sheets exceeds 10,000 sheets, a negative ghost of causing a non-printed area of a solid portion of 2×2 cm in halftone occurs.

In Comparative Example 4, from the initial step of the image formation, the formation of a ghost by transfer inferior is seen and with the increase of the number of printed sheets, the occurrence of transfer ghost becomes severe. Also, when the number of printed sheets exceeds 2,000 sheets, density lowering and a negative ghost of forming a non-printed area of a solid portion of 2×2 cm occur in halftone. Furthermore, when the number of printed sheets exceeds 10,000 sheets, white spots considered to be caused by attaching of the aggregates of titanium oxide fine particles on a charging roll occur on images formed.

As described above, according to the invention, by keeping a high toner transfer efficiency for a long period of time, and an image-forming process, toners, and an image-forming apparatus capable of reducing the amount of toner to be recovered and wasted, and further obtaining stabilized images without generating image quality defects such as density lowering, density unevenness, ghosts, fog, etc., for a long period of time can be provided.

What is claimed is:

1. An image-forming process for forming an image on a transfer material, comprising a developing step of obtaining a toner image by developing an electrostatic latent image on an electrostatic latent image holder surface using a layer of a developer containing a toner on the surface of a developer holder, a transfer step of transferring the toner image onto the surface of a transfer member, and a fixing step of fixing the toner image on the surface of the transfer member, wherein the toner contains at least toner particles and inorganic fine particles, the inorganic fine particles transfer from the toner to the electrostatic latent image holder surface and attach thereto, and the attached amount of the inorganic fine particles to the electrostatic latent image holder surface is from about 1 to 20% by the average occupied area ratio ($C_{AV}$) in the electrostatic latent image holder surface, and the difference ($C_{MAX}$–$C_{MIN}$) of the maximum occupied area ratio and the minimum occupied area ratio of the inorganic fine particles attached to the electrostatic latent image holder surface is not larger than about 5%.

2. The image-forming process according to claim 1 wherein the ratio (a2/a1) of an average primary particle size (volume average primary particle size) (a1) of the inorganic fine particles contained in the toner and an average aggregated particle size (volume average aggregate particle size) (a2) of the inorganic fine particles transferred and attached is not larger than about 5.

3. The image-forming process according to claim 2 wherein the inorganic fine particles are subjected to a surface hydrophobic treatment and the average primary particle size (a1) is from about 10 to 50 nm.

4. The image-forming process according to claim 1 wherein the ratio ($C/C_0$) of a calculated covering ratio ($C_0$) of the inorganic fine particles in the surface of the toner particles and an actually measured covering ratio (C) is at least about 0.6.

5. The image-forming process according to claim 1 wherein the inorganic fine particles are attached to the toner particles, and in the attached inorganic fine particles, the ratio of the weakly attached inorganic fine particles is not more than about 40% by weight and the ratio of the strongly attached inorganic fine particles is not more than about 80% by weight.

6. The image-forming process according to claim 1 wherein the inorganic fine particles are titanium oxide fine particles having a volume resistivity of from about $1\times10^{10}$ to $1\times10^{14}$ Ω cm.

7. The image-forming process according to claim 1 wherein the calculated covering ratio ($C_0$) of the inorganic fine particles in the surfaces of the toner particles is from about 10 to 50%.

8. The image-forming process according to claim 1 wherein the sphericity of the toner particles is not larger than about 130.

9. The image-forming process according to claim 1 wherein the toner particles further having an additive, which is spherical fine particles, on the surfaces thereof, the average primary particle size of the additive is larger than the average primary particle size of the inorganic fine particles, and the average primary particle size of the additive is from about 30 to 200 nm.

10. The image-forming process according to claim 9, wherein the inorganic fine particles are titanium oxide fine particles having a volume resistivity of from about $1\times10^{10}$ to $1\times10^{14}$ Ω cm.

11. The image forming process according to claim 1 wherein the transfer of the inorganic fine particles is defined as the transferring when the image forming process is repeatedly completed up to approximately 1000 times.

12. An image-forming process for forming an image on a transfer material, comprising a developing step of obtaining a toner image by developing an electrostatic latent image on an electrostatic latent image holder surface using a layer of a developer containing at least a toner on the surface of a developer holder, a first transfer step of transferring the toner image onto the surface of an intermediate transfer member, a second transfer step of transferring the toner image on the surface of the intermediate transfer member onto the surface of a second transfer material, and a fixing step of fixing the toner image on the surface of the second transfer material, wherein the toner contains at least toner particles and inorganic fine particles, the inorganic fine particles transfer from the toner to the electrostatic latent image holder surface and attach thereto, and the attached amount of the inorganic fine particles to the electrostatic latent image holder surface is from about 1 to 20% by the average occupied area ratio ($C_{AV}$) in the electrostatic latent image holder surface, and the difference ($C_{MAX}$–$C_{MIN}$) of the maximum occupied area ratio and the minimum occupied area ratio of the inorganic fine particles attached to the electrostatic latent image holder surface is not larger than about 5%.

13. The image-forming process according to claim 12 wherein the ratio (a2/a1) of an average primary particle size (volume average primary particle size) (a1) of the inorganic fine particles contained in the toner and an average aggregated particle size (volume average aggregate particle size) (a2) of the inorganic fine particles transferred and attached is not larger than about 5.

14. The image-forming process according to claim 12 wherein the inorganic fine particles are subjected to a surface hydrophobic treatment and the average primary particle size (a1) is from about 10 to 50 nm.

15. The image-forming process according to claim 12 wherein the ratio ($C/C_0$) of a calculated covering ratio ($C_0$) of the inorganic fine particles in the surface of the toner particles and an actually measured covering ratio (C) is at least about 0.6.

16. The image-forming process according to claim 12 wherein the inorganic fine particles are attached to the toner particles, and in the attached inorganic fine particles, the ratio of the weakly attached inorganic fine particles is not more than about 40% by weight and the ratio of the strongly attached inorganic fine particles is not more than about 80% by weight.

17. The image-forming process according to claim 12 wherein the inorganic fine particles are titanium oxide fine particles having a volume resistivity of from about $1\times10^{10}$ to $1\times10^{14}$ Ω cm.

18. The image-forming process according to claim 12 wherein the calculated covering ratio ($C_0$) of the inorganic fine particles in the surfaces of the toner particles is from about 10 to 50%.

19. The image-forming process according to claim 12 wherein the sphericity of the toner particles is not larger than about 130.

20. The image-forming process according to claim 12, wherein the toner particles further comprise an additive, which is spherical fine particles, on the surface thereof, the average primary particle size of the additive being larger than the average primary particle size of the inorganic fine particles, and the average primary particle size of the additive being from about 30 to 200 nm.

* * * * *